US012779306B2

(12) United States Patent
Adams et al.

(10) Patent No.: US 12,779,306 B2
(45) Date of Patent: Nov. 3, 2026

(54) SPORTS TRAINING SYSTEM AND METHOD

(71) Applicant: OpenGym LLC, Flower Mound, TX (US)

(72) Inventors: Chris Dana Adams, Flower Mound, TX (US); Jules Ryckebusch, Highland Village, TX (US)

(73) Assignee: Open Gym LLC, Flower Hound, TX (US)

( * ) Notice: Subject to any disclaimer, the term of this patent is extended or adjusted under 35 U.S.C. 154(b) by 301 days.

(21) Appl. No.: 18/772,889

(22) Filed: Jul. 15, 2024

(65) Prior Publication Data

US 2024/0367021 A1 Nov. 7, 2024

Related U.S. Application Data

(63) Continuation-in-part of application No. 17/686,090, filed on Mar. 3, 2022, now abandoned.

(51) Int. Cl.
*A63B 69/00* (2006.01)
*A63B 71/06* (2006.01)

(52) U.S. Cl.
CPC ..... *A63B 69/0071* (2013.01); *A63B 71/0605* (2013.01); *A63B 71/0622* (2013.01);
(Continued)

(58) Field of Classification Search
CPC ..... A63B 69/0071; A63B 63/083; A63B 2225/50; A63B 2220/833; A63B 63/00;
(Continued)

(56) References Cited

U.S. PATENT DOCUMENTS 5,388,821 A * 2/1995 Blackburn ..... A63B 63/083 473/484
5,401,015 A * 3/1995 Woodall ..... A63B 63/083 473/481

(Continued)

FOREIGN PATENT DOCUMENTS

CN 207785826 U * 8/2018
CN 208553039 U * 3/2019

(Continued)

OTHER PUBLICATIONS

CN 112891885 A (Year: 2021).*

(Continued)

*Primary Examiner* — John E Simms, Jr.
*Assistant Examiner* — Amir A Klayman

(57) ABSTRACT

An adjustable sports training system comprises a mounting infrastructure comprising a pair of angled arms and a cylindrical shaft, a goal structure fixed to the shaft's inferior portion, a pivot mechanism mounted to the shaft and configured to rotate the goal structure, and a computerized control system configured to remotely adjust the pivot mechanism. The pivot mechanism further includes a servomechanism, a high ratio gearbox, a shaft coupler, a housing and a pair of bearings through which the shaft runs. The servomechanism comprises a servomotor connected to the gearbox and configured to provide rotational movement of the shaft and connected goal structure, a drive device having logic level and ethernet connectivity, a DC power supply, a DC power cable, and a servomotor cable.

17 Claims, 18 Drawing Sheets

(52) U.S. Cl.
CPC ... *A63B 2071/0675* (2013.01); *A63B 2214/00* (2020.08); *A63B 2220/807* (2013.01); *A63B 2225/50* (2013.01); *A63B 2225/74* (2020.08)

(58) Field of Classification Search
CPC ..... A63B 2220/13; A63B 71/0605; A63B 71/0622; A63B 2225/74; A63B 2214/00; A63B 2071/0675; A63B 2220/807
See application file for complete search history.

(56) References Cited

U.S. PATENT DOCUMENTS

| | | | | | |
|---|---|---|---|---|---|
| 5,677,896 | A * | 10/1997 | Nunes | F21V 33/008 | D26/54 |
| 6,368,240 | B1 * | 4/2002 | Pohrer | A63B 63/083 | 473/483 |
| 6,536,770 | B1 * | 3/2003 | Yang | A63B 63/06 | 273/371 |
| 6,918,591 | B2 * | 7/2005 | D'Amico | A63B 69/0071 | 473/433 |
| 8,052,544 | B2 * | 11/2011 | Tien | A63B 69/0071 | 473/433 |
| 10,688,362 | B1 * | 6/2020 | Sangalang | A63B 63/06 | |
| 11,124,253 | B1 * | 9/2021 | Yang | B62D 63/061 | |
| 11,364,426 | B2 * | 6/2022 | Brown | A63B 71/0622 | |
| 2013/0296079 | A1 * | 11/2013 | Schwartz | A63B 47/025 | 473/422 |
| 2014/0156042 | A1 * | 6/2014 | Marty | A63B 24/0021 | 700/91 |
| 2014/0213414 | A1 * | 7/2014 | Balandis | A63B 21/169 | 482/111 |
| 2016/0325168 | A1 * | 11/2016 | Campbell | A63B 69/408 | |
| 2022/0121077 | A1 * | 4/2022 | Giron | G02F 1/1523 | |
| 2023/0053992 | A1 * | 2/2023 | Krivak | A63B 69/0071 | |
| 2025/0032878 | A1 * | 1/2025 | Adams | A63B 69/0071 | |
| 2025/0144496 | A1 * | 5/2025 | Hemple | A63B 71/0622 | |
| 2026/0199753 | A1 * | 7/2026 | Zhang | A63B 63/083 | |

FOREIGN PATENT DOCUMENTS

| | | | | |
|---|---|---|---|---|
| CN | 112891885 | A * | 6/2021 | A63B 69/407 |
| CN | 113144551 | A * | 7/2021 | A63B 47/02 |
| CN | 115054895 | A * | 9/2022 | A63B 69/0071 |
| CN | 116212340 | A * | 6/2023 | A63B 69/0071 |
| CN | 121177733 | A * | 12/2025 | H04N 5/76 |
| LU | 508990 | B1 * | 5/2025 | A63B 63/083 |

OTHER PUBLICATIONS

CN 113144551 A (Year: 2021).*
CN 115054895 A (Year: 2022).*
CN 116212340 A (Year: 2023).*
CN 121177733 A (Year: 2025).*
CN-208553039-U (Year: 2019).*

* cited by examiner

FIG. 17a
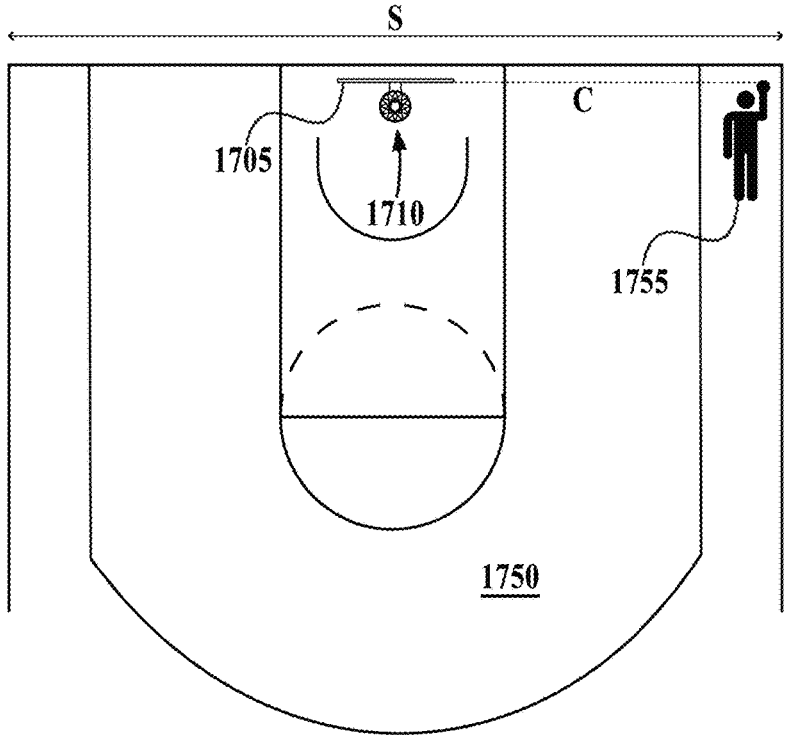
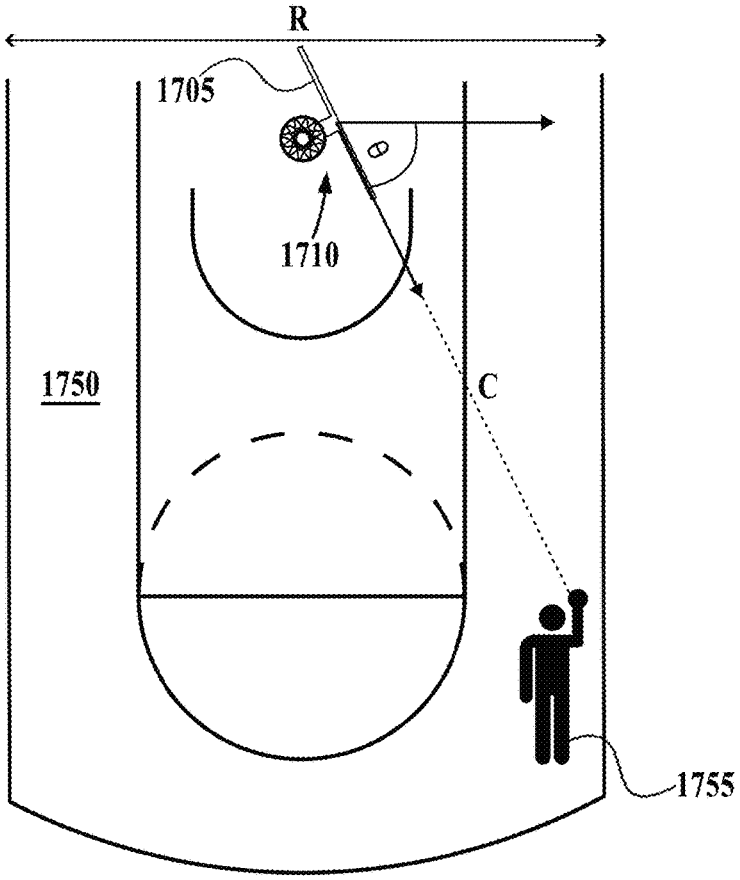
FIG. 17b

SPORTS TRAINING SYSTEM AND METHOD

RELATED U.S. APPLICATION DATA

This application claims priority to Non-Provisional application Ser. No. 17/686,090 filed on Mar. 3, 2022.

FIELD OF THE INVENTION

This disclosure relates to the field of sports training systems.

BACKGROUND

Athletes, parents of young athletes, and others desire access to great training, a great trainer, or a great coach. Along with the motivation and desire to train, a physical environment that is conducive, functional, and available is required. Basketball play and training is constrained by space requirements. Full teams use the traditional basketball gyms to train. A small gym that is not intended to house fans and just focused on training will typically have 5,000 square feet of space with 25+ foot high ceilings. The interior training space will at a minimum consist of the flooring, which has court markings painted or taped on and a stationary basketball hoop at each end of the court. Typically, a minimum of a "half-court" is required for effective training. This is due to the needs of the athlete to practice shooting straight on the basket and from both the left and right sides of the basket. Often, gyms in high schools and colleges will have multiple backboards and hoops that can be brought into place along the sides of the gym to allow multiple people to practice simultaneously. This limits what each person or small group can accomplish in the reduced space allotted to them. Use of the full or half-court in a facility is limited to both individual athletes and coaches due to availability and use by larger groups. Athletes and their families spend considerable time and money for serious basketball training. Unfortunately, much of the feedback provided by coaches and trainers is subjective and not equally well received or understood by all athletes.

There is a need in the art for a system and method that allows the athlete to remain stationary while experiencing different spatial configurations between them and the basketball hoop. Further, there is a need for more objective training systems and methods that provide more useful, objective feedback in the form of hard data to the athlete.

SUMMARY

An adjustable sports training system installed in a training space having a basketball court comprises a mounting infrastructure comprising a pair of angled arms and a cylindrical shaft, the shaft having a superior portion and an inferior portion, the superior portion positioned between the angled arms, each angled arm terminating at two opposing fixed ends; a goal structure fixed to the shaft's inferior portion, the goal structure comprising a backboard with an attached hoop, the hoop having an attached net, the backboard embedded with lighted displays and a ball sensor; a pivot mechanism configured to rotate the goal structure, the pivot mechanism mounted to the shaft and comprising a servomechanism, a high ratio gearbox, a shaft coupler, a housing, and a pair of bearings through which the shaft runs, one bearing being positioned at the shaft's superior portion while the other bearing is positioned at the inferior portion, the housing attached to each angled arm at a fixed end, the opposing fixed ends positioned further away from the shaft's superior portion than those fixed ends attached to the housing, the shaft coupler rigidly connecting the gearbox to the superior portion. The servomechanism comprises a servomotor connected to the gearbox and configured to provide rotational movement of the shaft and connected goal structure, a drive device having logic level and ethernet connectivity, a DC power supply, a DC power cable, and a servomotor cable, the DC power supply being in electrical communication with the drive device via the DC power cable, the drive device being in electrical communication with the servomotor via the servomotor cable, the gearbox configured to increase torque provided by the servomotor, the housing positioned between the bearings and containing the DC power supply, DC power cable, and drive device. The sports training system also includes a computerized control system configured to remotely adjust the pivot mechanism, wherein the control system includes a central computing device, a local area network router in communication with both the central computing device and the drive device such that two-way data transmission occurs between all three devices, the router having cloud connectivity and, a mobile computing device in wireless communication with the central computing device, such that the drive device receives adjustment commands from the mobile device to rotate the goal structure via the servomechanism, the mobile device configured to have a plurality of graphical user interfaces for receiving the adjustment commands, the interfaces further receiving commands for initiating athlete training programs, the commands receivable via touch interaction.

In one aspect of the adjustable sports training system, wherein the servomotor includes an integrated position sensor and an internal brake configured to prevent rotation from occurring when not desired, the position sensor further configured to allow the control system to initialize the pivot mechanism to a standard rotational position upon power loss, or due to movement when the sports training system is not in use. In another aspect of the adjustable sports training system, the drive device provides electrical signals to control the servomotor using programmed values for angular position, acceleration, velocity, and jerk, the programmed values calculated based upon the weight, material composition, movements, and construction of the goal structure. In another aspect of the adjustable sports training system, the mobile computing device's graphical interfaces include a pivot operation screen and a challenge selection screen, the pivot operation screen receiving the adjustment commands and including a graphical element for a pivot locking setting that changes graphically between an open lock icon and a closed lock icon, the challenge selection screen receiving both the adjustment commands and the training program commands, the training programs being timed and periodically providing automatic rotation of the goal structure.

In another aspect of the adjustable sports training system, the central computing device includes a javascript engine to support programming of training programs, web sockets, and python to support communication with the drive device and provide the automated periodic movement of the pivot mechanism. In another aspect of the adjustable sports training system, the drive device is configured to receive positional commands through the logic level and ethernet connectivity using a client/server data communications protocol known as MODBUS. In another aspect of the adjustable sports training system, the shaft coupler maintains angular positioning accuracy while rigidly connecting the gearbox to the superior portion of the shaft, promoting the ability to absorb maximal force from an angular impact incurred by a basketball at a distal edge of the backboard, the force absorption allowing the dissipation of vibration while maintaining alignment of the backboard with negligible drift or flexing, and wherein the gearbox increases the angular positioning ability of the pivot mechanism to an accuracy of within 30 arc minutes. In another aspect of the adjustable sports training system, the high ratio gearbox utilizes gear ratios lying in a range between 80:1 to 100:1, wherein the drive device stores position data in non-volatile memory, and wherein the sports training system further comprises a plurality of cameras monitoring the training space, the cameras being in communication with the control system. In another aspect of the adjustable sports training system, the training equivalence is achieved in a size-reduced half-court where the goal structure is rotated by the pivot mechanism, the training relative to that accomplished in a standard half-court having a standard width of approximately 50 feet, the size-reduced half-court having a reduced width of approximately 20 feet.

In another embodiment, the sports training system comprises a mounting infrastructure comprising a pair of angled arms and a cylindrical shaft, the shaft having a superior portion and an inferior portion, the superior portion positioned between the angled arms; a goal structure fixed to the shaft's inferior portion; and a pivot mechanism configured to rotate the goal structure, the pivot mechanism positioned at the shaft's superior portion. The pivot mechanism comprises a servomechanism comprising a servomotor and a drive device, the servomotor comprising an integrated position sensor and an internal brake, the drive device configured to receive positional commands via logic level and ethernet connectivity using a client/server data communications protocol known as MODBUS; a high ratio gearbox; a shaft coupler rigidly connecting the gearbox to the shaft's superior portion; a housing containing the drive device; and a pair of bearings through which the shaft runs. The training system also includes a computerized control system configured to remotely adjust the pivot mechanism, the control system comprising a central computing device having a javascript engine to support communication with the drive device and provide automated periodic movement of the pivot mechanism; a local area network router in communication with both the central computing device and the drive device such that two-way data transmission occurs between all three devices, the router having cloud connectivity; a mobile computing device in wireless communication with the central computing device, such that the drive device receives adjustment commands from the mobile device to rotate the goal structure via the pivot mechanism, the mobile device configured to have a plurality of graphical user interfaces for receiving adjustment commands to rotate the goal structure, the interfaces further receiving commands for initiating athlete training programs, the interfaces including a pivot operation screen and a challenge selection screen; and a plurality of cameras monitoring the training space, the cameras being in communication with the control system.

In one aspect of the adjustable sports training system, the position sensor is configured to allow the control system to initialize the pivot mechanism to a standard rotational position upon power loss, or due to movement when the sports training system is not in use. In another aspect of the adjustable sports training system, the drive device provides electrical signals to control the servomotor using programmed values for angular position, acceleration, velocity, and jerk, the programmed values calculated based upon the weight, material composition, movements, and construction of the goal structure. In another aspect of the adjustable sports training system, the pivot operation screen includes a graphical element for a pivot locking setting that changes graphically between an open lock icon and a closed lock icon, and wherein the challenge selection screen receives both the adjustment commands and the training program commands, the training programs being timed and periodically providing automatic rotation of the goal structure.

In another aspect of the adjustable sports training system, the shaft coupler maintains angular positioning accuracy while rigidly connecting the gearbox to the superior portion of the shaft, promoting the ability to absorb maximal force from an angular impact incurred by a basketball at a distal edge of the backboard, the force absorption allowing the dissipation of vibration while maintaining alignment of the backboard with negligible drift or flexing, and wherein the gearbox increases the angular positioning ability of the pivot mechanism to an accuracy of within 30 arc minutes. In another aspect of the adjustable sports training system, the high ratio gearbox utilizes gear ratios lying in a range between 80:1 to 100:1. In another aspect of the adjustable sports training system, the drive device stores position data in non-volatile memory. In another aspect of the adjustable sports training system, training equivalence is achieved in a size-reduced half-court where the goal structure is rotated by the pivot mechanism, the training relative to that accomplished in a standard half-court having a standard width of approximately 50 feet, the size-reduced half-court having a reduced width of approximately 20 feet.

In another embodiment, a method is provided for using an adjustable sports training system, the method comprising: Initiating the sports training system's software-based training program for use by an athlete in a basketball court, the training program including challenges for the athlete, the training program running on a central computing device connected to a network router, the training program accessible by the athlete via a user interface running on a mobile computing device in communication with the central computing device, the sports training system including a goal structure having an integrated pivot mechanism with servomotor for rotating the goal structure into pivot positions, the goal structure comprising lighted displays, the pivot mechanism further comprising a drive device in communication with the central computing device, the drive device sending electrical signals to the servomotor to provide it with values of angular position, acceleration, velocity, and jerk for the pivoted goal structure, the pivot mechanism being adjustable via the user interface; Selecting a challenge and pivot position from the user interface, the challenge including dribbling and shooting basketballs toward the goal structure, the pivot position being either "left" or "right" relative to a standard training scenario on a standard court with a standard goal structure; Pressing "start" on the user interface; Beginning shot and motion drills, the drills including dribble sets, shots from stationary and non-stationary positions, and layups; Automatically rotating the goal structure into a new pivot position, the rotation executed by the central computing device; Continuing with a subsequent set of shot and motion drills at the new pivot position; Concluding the challenge and returning the goal structure to its original position via the pivot mechanism; and Providing feedback pertaining to the challenge, the feedback displayed on both the user interface and the goal structure's lighted displays.

In one aspect of the adjustable sports training system, the central computing device includes a javascript engine to support programming of training programs, web sockets, and python to support communication with the drive device and provide the automated periodic movement of the pivot mechanism. In another aspect of the adjustable sports training system, training equivalence is achieved in a size-reduced half-court where the goal structure is rotated by the pivot mechanism, the training relative to that accomplished in a standard half-court having a standard width of approximately 50 feet, the size-reduced half-court having a reduced width of approximately 20 feet.

BRIEF DESCRIPTION OF THE DRAWINGS

FIGS. 17A-B illustrate equivalent training in a reduced space using the pivot mechanism as compared with a standard space in accordance with an embodiment of the present disclosure.

DETAILED DESCRIPTION

Figure 1:
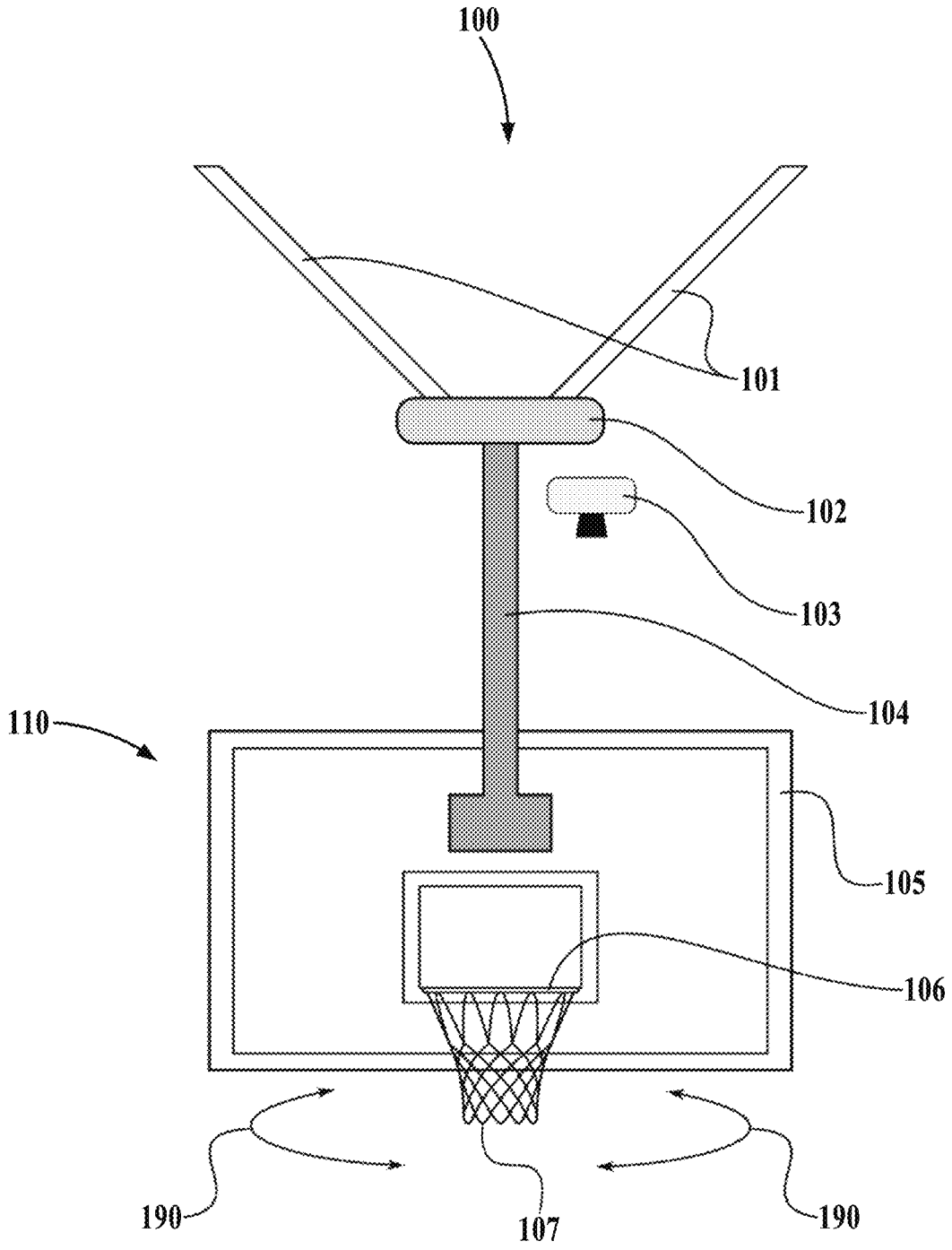
FIG. 1 is an illustration of a disclosed pivot mechanism.

FIG. 1 illustrates one embodiment of a sports training system 100, and shows how a pivot mechanism 102, is superiorly connected to a mounting infrastructure 101, and inferiorly connected to a shaft 104, in such a way that a large portion of each of the two structures lies substantially above and below the pivot mechanism 102, respectively. The shaft 104 is fixed in its lower region to the goal structure 110, which further comprises backboard 105, with hoop 106 and attached net 107. The pivot mechanism 102 provides a means of precise rotation for the shaft 104 which in turn rotates, or "pivots", the connected goal structure 110, as indicated by rotational arrows 190. The resulting adjusted positions provide different training configurations for an athlete when making shots, while allowing the athlete to remain stationary with respect to the goal structure 110. A ball sensor 103 provides input to the sports training system 100 for detection of shot attempts and completions. In one embodiment, this sensor 103 may utilize an enhanced camera, while also employing a plurality of detection components in order to gather more data regarding the physics of the ball in motion, including velocity, trajectory, force/impact, spin, and other useful data. The system 100 can gather and process the data in real-time, yielding continuous training feedback for athletes and coaches, who can then note trends and patterns and diagnose problem areas in training and overall player performance.

Figure 2:
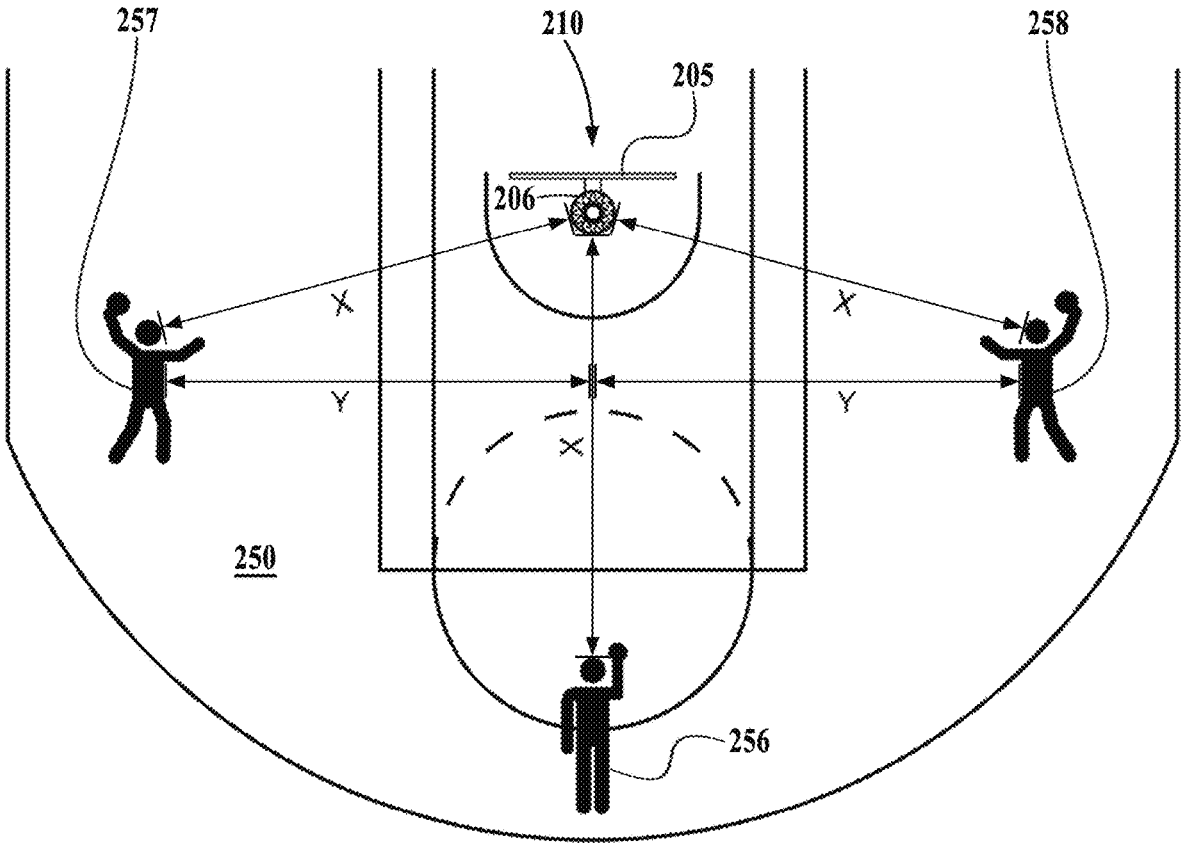
FIG. 2 is an illustration of spatial relationships in basketball training.

For the purposes of illustration, FIG. 2 shows the current state of basketball practice and training on a standard court 250. Three scenarios help to demonstrate the spatial relationship between an athlete and the goal structure 210 with backboard 205 and hoop 206. In each of these scenarios, the athlete assumes a different training position on the court 250, including a central position 256, a left-of-center position 257, and a right-of-center position 258, wherein the athlete faces the goal structure 210 at a different angle. In each position, the athlete stands at the same shooting distance from the goal structure 210, as indicated by distance lines X. In a central position 256, the athlete faces the goal structure 210 directly, for a frontal view of the backboard 205. There are two scenarios where the athlete must be displaced from the central position 256 by some distance, indicated by distance lines Y, in order to shoot the basketball at an angle with respect to the goal structure 210. The aforementioned left-of-center position 257 lets the athlete face the left side of the goal structure 210, while the right-of-center position 258 lets the athlete face the right side of it. In these angled training positions, displaced by a distance Y to the left or right of the central position 256, the athlete changes perspective for an oblique view of the backboard 205, which generally requires a higher level of shooting precision. When practicing shooting in particular, the act of continuously traversing the court in pursuit of varied and angled shots requires a certain level of focus, while also demanding an expenditure of energy that may be undesirable for certain exercises. Additionally, small and/or busy gym spaces can force coaches and trainers to organize more chaotic group drills with excessive court movement in order to vary shooting practice, when it may be desirable to focus on court movement and shooting separately-especially for younger athletes who may have trouble immediately combining the two skills.

Figure 3:
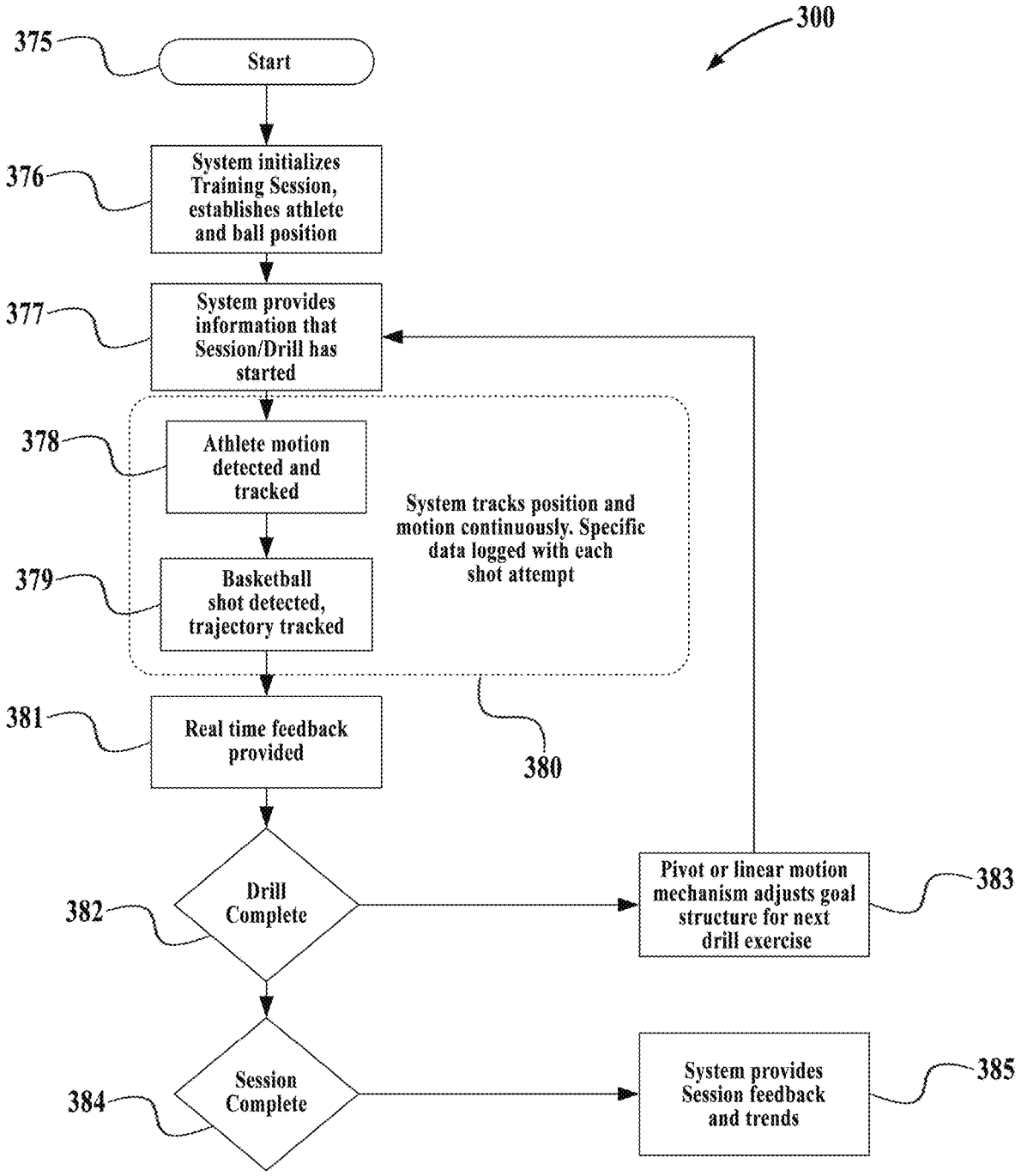
FIG. 3 illustrates a process for athletic training using a sports training system with adjustable hardware in accordance with an embodiment of the present disclosure.

FIG. 3 outlines the overall process for athletic training, with monitoring and data processing that yields activity feedback, using a sports training system 300 with adjustable hardware in accordance with an embodiment of the present disclosure. Beginning with step 375, an operator (such as a coach or trainer) initiates a training program. The system 300 then initializes a training session on both a program/parameter level and a hardware level, adjusting the goal structure (see adjustable goal structure 110 and 1110 of FIGS. 1 and 11, respectively), and establishing the current position of both basketball and athlete, as shown in step 376. With the current session initialized, the system 300 is ready to operate relevant hardware to monitor a first drill for the athlete, outwardly providing any relevant session/drill information along with a signal to begin, as indicated by step 377. As the athlete commences training, their motion is detected and tracked, as noted by step 378. Similarly, as noted by step 379, the athlete's shots are detected and tracked, allowing trajectory data to be gathered by the system 300 as well. Box 380 elaborates upon features of the aforementioned ball/athlete tracking, including how the system 300 performs the motion tracking continuously throughout the drill, and that specific data is logged with each shot attempt, thereby allowing for both micro analyses of individual shots and/or athlete performance, and post-training macro analyses of larger data sets, since the data is cumulative. In any case, as shown by step 381, a useful amount of real time feedback based on the tracking data can be provided to coaches and athletes alike throughout a live session/drill. At some point, depending either on the parameters set for the session or an operator's decision, the drill reaches its conclusion, as noted by step 382. At this point, the operator or an automatic session parameter can end the session, as indicated by step 384, or a new drill can immediately follow, wherein the pivot mechanism (see pivot mechanism 102 of FIG. 1) or a linear motion mechanism (see mechanism illustrated in FIGS. 11 and 12) rotates or linearly adjusts the goal structure, respectively (see goal structure 110 and 1110 of FIGS. 1 and 11, respectively) into a new configuration (see training configurations 430, 531, 632, and 1033/1034 of FIGS. 4, 5, 6, and 10, respectively), as indicated by step 383. If the session continues with the new drill, the system 300 once again provides a start signal for the athlete and the new drill begins, once again, as shown by step 377. If, as step 384 indicates, the full session is complete, the system 300 can then provide more comprehensive session feedback and outline trends from overarching data sets, as indicated by step 385. Successive session feedback continues to be useful in the above-mentioned macro analyses, which can be highly informative in the process of corrective training, and in pursuing long-term athlete development.

Figure 4:
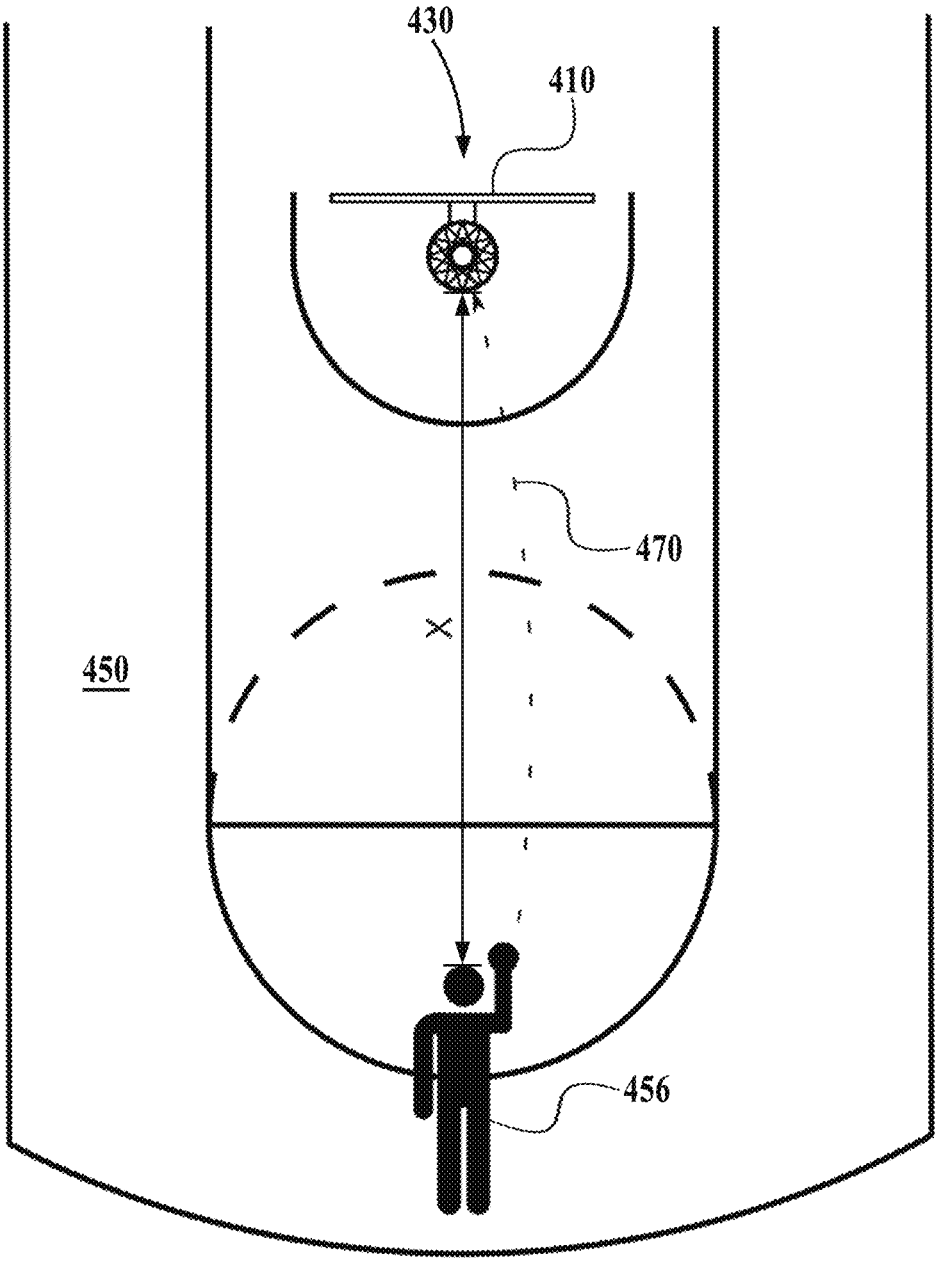
FIG. 4 illustrates a "Scenario A" training configuration with a pivot mechanism having 0° rotation in accordance with an embodiment of the present disclosure.

FIG. 4 illustrates a "Scenario A" training configuration in accordance with an embodiment of the present disclosure. In this and further discussions of training configurations, the object of the configuration is the rotatable goal structure 410, while each "scenario" is broader and encompasses the sum of athlete position and training configuration. As depicted in FIG. 4, training configuration 430 provides a standard training angle (or "normal position") wherein the pivot mechanism (see pivot mechanism 102 of FIG. 1) applies 0° rotation to the goal structure 410. In this configuration 430, the goal structure 410 is essentially identical to a standard goal structure, fully facing forward—as with the goal structure illustrated in FIG. 2. Similarly, the depicted athlete training position is once again the central position 456, which places the athlete in the training space or on the court 450 at the distance X from the goal structure 410 with a direct frontal view of it, corresponding with central position 256 in FIG. 2. "Scenario A" is hence a standard scenario that is non-simulative in nature, that is, it does not simulate an alternate court position for the athlete. Dashed line 470 indicates a ball trajectory resulting from a shot made by the athlete in central position 456 toward the front of the goal structure 410.

Figure 5:
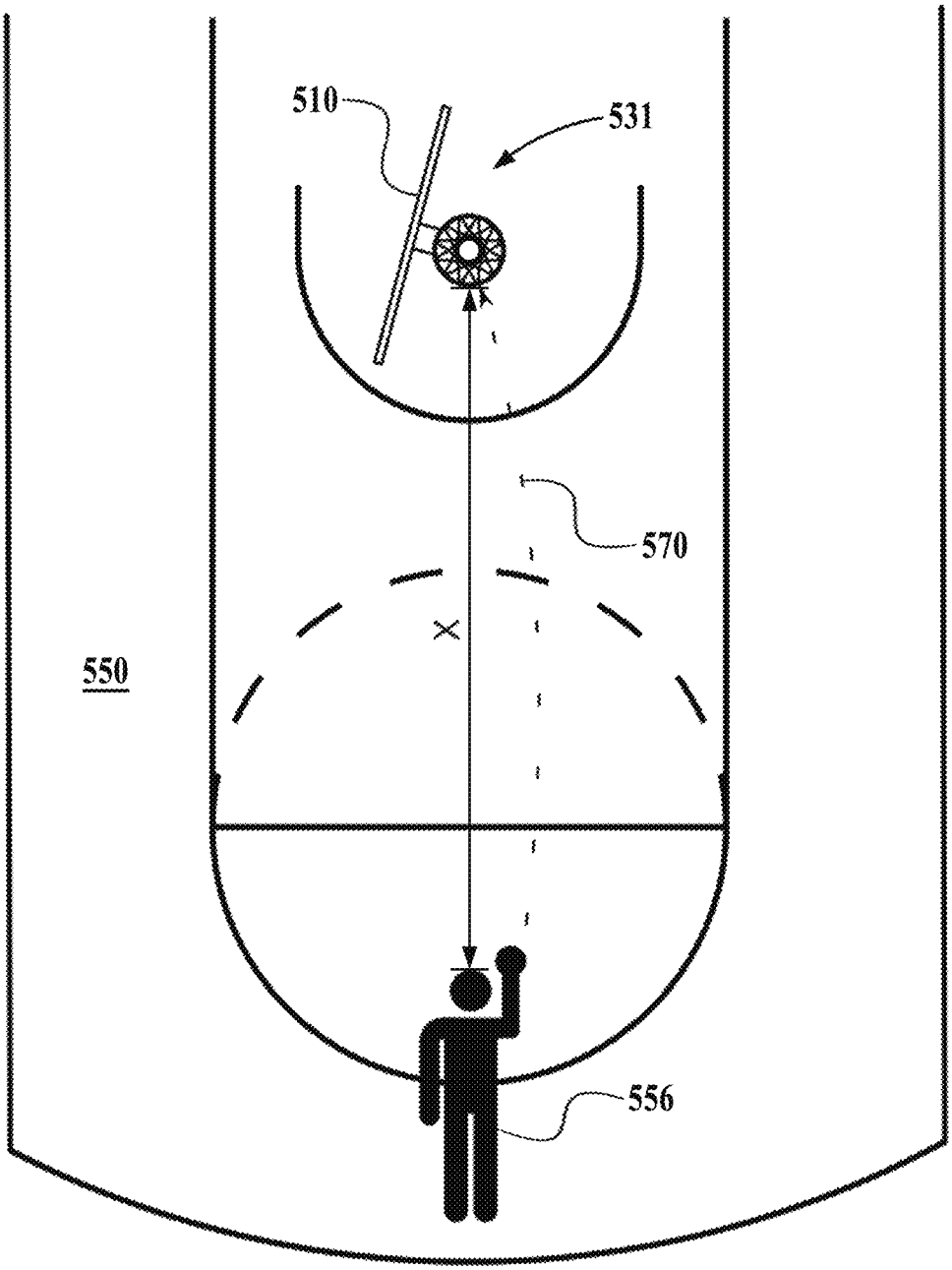
FIG. 5 illustrates a "Scenario B" training configuration with the pivot mechanism rotating the basketball backboard, hoop, and net counterclockwise to simulate a left-of-center training position for the athlete.

FIG. 5 illustrates a "Scenario B" training configuration in accordance with an embodiment of the present disclosure. Here, training configuration 531 provides an oblique training angle wherein the pivot mechanism (see pivot mechanism 102 of FIG. 1) applies some degree of counterclockwise rotation to the goal structure 510. The depicted athlete position is still the central position 556, placing the athlete on the court 550 at the distance X from the goal structure 510, as in the previous figure. Yet in this scenario, it is as if the athlete has suddenly been displaced from the central position 556 by a certain distance (see distance Y of FIG. 2) and has now assumed the previously mentioned left-of-center position (see left-of-center position 257 of FIG. 2), gaining access to the same viewing angle of the goal structure 510 as the athlete in that position, while remaining completely stationary. In this way, "Scenario B" simulates the left-of-center position while the athlete remains in central position 556. Dashed line 570 indicates the ball trajectory resulting from a shot made by the athlete in central position 556 toward the left side of the goal structure 510.

Figure 6:
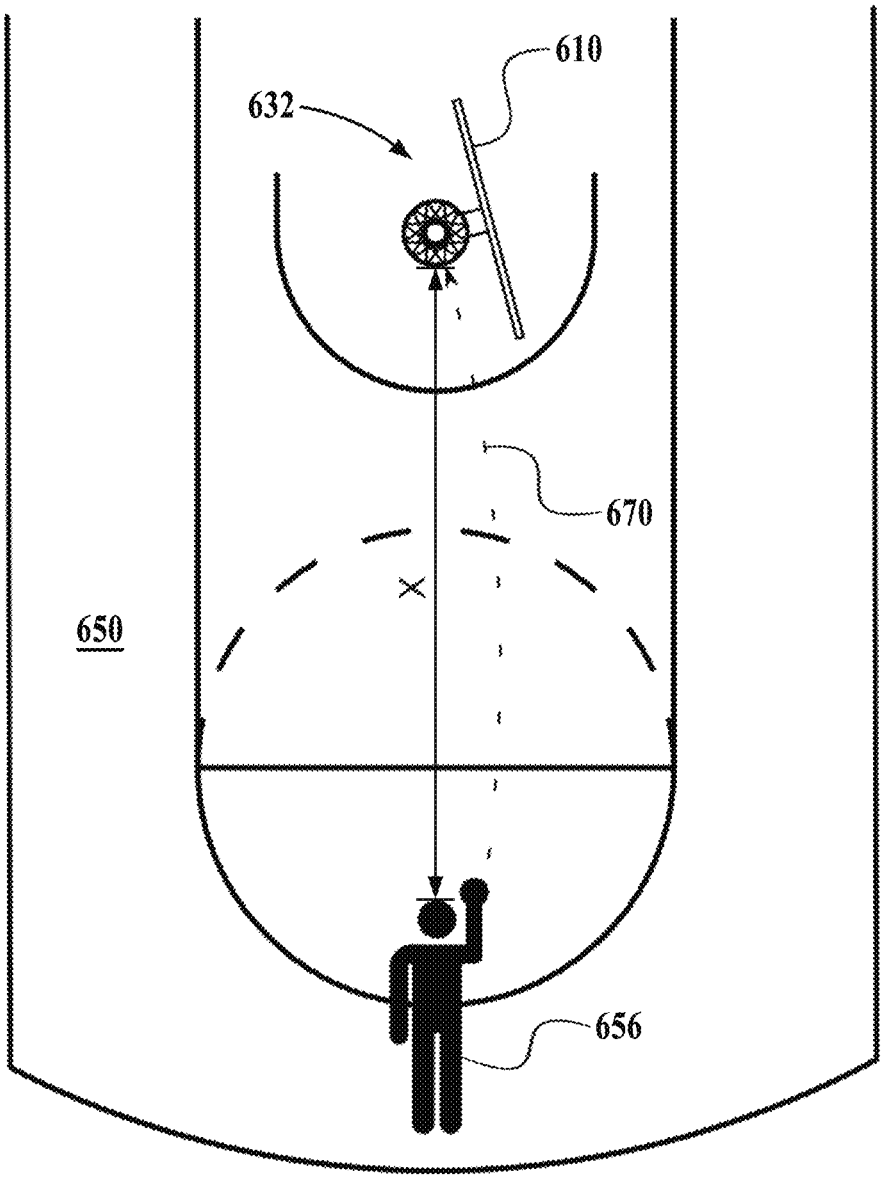
FIG. 6 illustrates a "Scenario C" training configuration with the pivot mechanism rotating the basketball backboard, hoop, and net clockwise to simulate a right-of-center training position for the athlete.

FIG. 6 illustrates a "Scenario C" training configuration in accordance with an embodiment of the present disclosure. Here, training configuration 632 provides another oblique training angle, this time wherein the pivot mechanism (see pivot mechanism 102 of FIG. 1) applies some degree of clockwise rotation to the goal structure 610. The depicted athlete position is still the central position 656, placing the athlete on the court 650 at the same distance X from the goal structure 610, as in the previous two figures. In this scenario, it is as if the athlete has now been displaced from the central position 656 by a certain distance (see distance Y of FIG. 2) and has now assumed the previously mentioned right-of-center position (see right-of-center position 258 of FIG. 2), gaining access to the same viewing angle of the goal structure 610 as the athlete in that position, while once again remaining completely stationary. In this way, "Scenario C" simulates the right-of-center position while the athlete remains in central position 656. Dashed line 670 indicates the ball trajectory resulting from a shot made by the athlete in central position 656 toward the right side of the goal structure 610.

In any scenario, considering team practices or packed gyms, multiple stationary athletes can physically assume not only the central position, but also the abovementioned left-of-center, and right-of-center court positions (displaced from central position 256 by distance Y, see FIG. 2) while the goal structure pivots. In this way, many athletes can equally take advantage of continuously varied angled shooting without the usually required court movement, thereby optimizing court space and drill efficiency, promoting a generally more organized training environment, and saving time and energy for both athletes and coaches alike.

Figure 7:
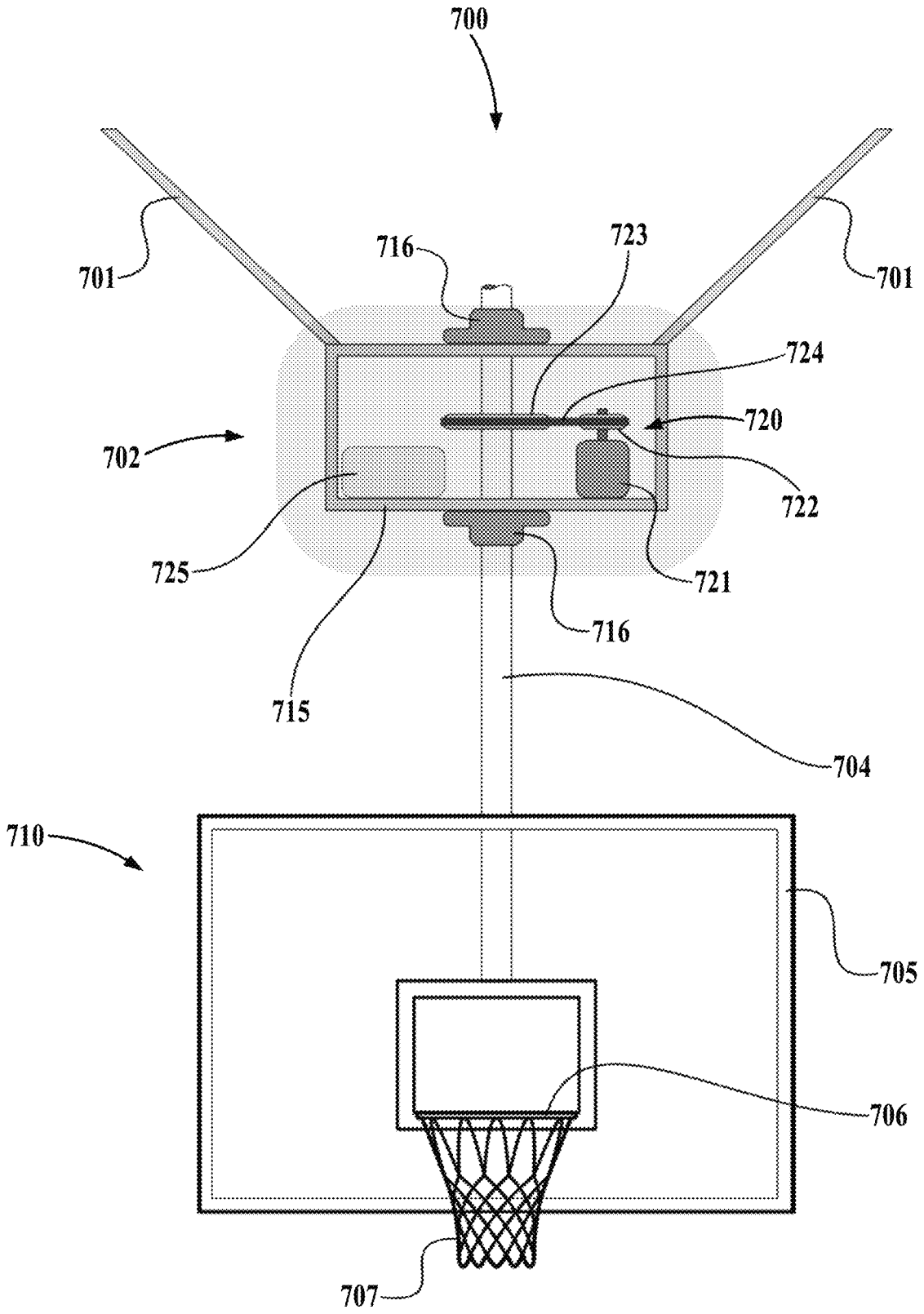
FIG. 7 illustrates an embodiment of the pivot mechanism in accordance with the present disclosure.

FIG. 7 illustrates one embodiment of the pivot mechanism 702, installed via mounting infrastructure 701, and details a pivot mechanism housing 715 that supports the overall assembly and provides a sufficient mounting area for bearings 716. These bearings allow angular rotation of the shaft 704, while preventing vertical movement. The shaft 704 is mounted on its lower end by the goal structure 710 with backboard 705, hoop 706, and net 707. Angular rotation of the shaft 704 translates to rotational pivot movements of the entire goal structure 710. A rotational subassembly 720 lying within the housing 715 includes a rotation mechanism 721 which may comprise a stepper motor and provides rotational torque in specific angular increments. The rotation mechanism 721 can hold a torqued position in place to prevent further angular rotation of the goal structure 710 that is undesired. Rotational subassembly 720 further comprises a plurality of gears, including a small gear 722 and large gear 723, as well as a chain 724, which together complete the transfer of torque from rotation mechanism 721 to shaft 704. In another embodiment, a plurality of chains, gears, and motors may be implemented into the subassembly 720 as needed in order to optimize the performance of the pivot mechanism 702 and overall sports training system 700. Within the pivot mechanism housing 715 sits a computerized control system 725 which performs a plurality of functions, including: receiving incoming motion commands for rotation that may include direction of rotation and angular distance, driving the motor 721 to cause rotation to the newly specified angular position, maintaining accurate positional information that can be queried and retrieved, determining the position of the goal structure 710 upon system initialization and centering it to zero degrees relative to the training court (i.e. the goal structure's "normal position"), receiving an external calibration command that will determine the position of the goal structure 710 to re-center, receiving external information and data to provide to the user, and sending the user feedback information to be displayed in the backboard 705.

Figure 8:
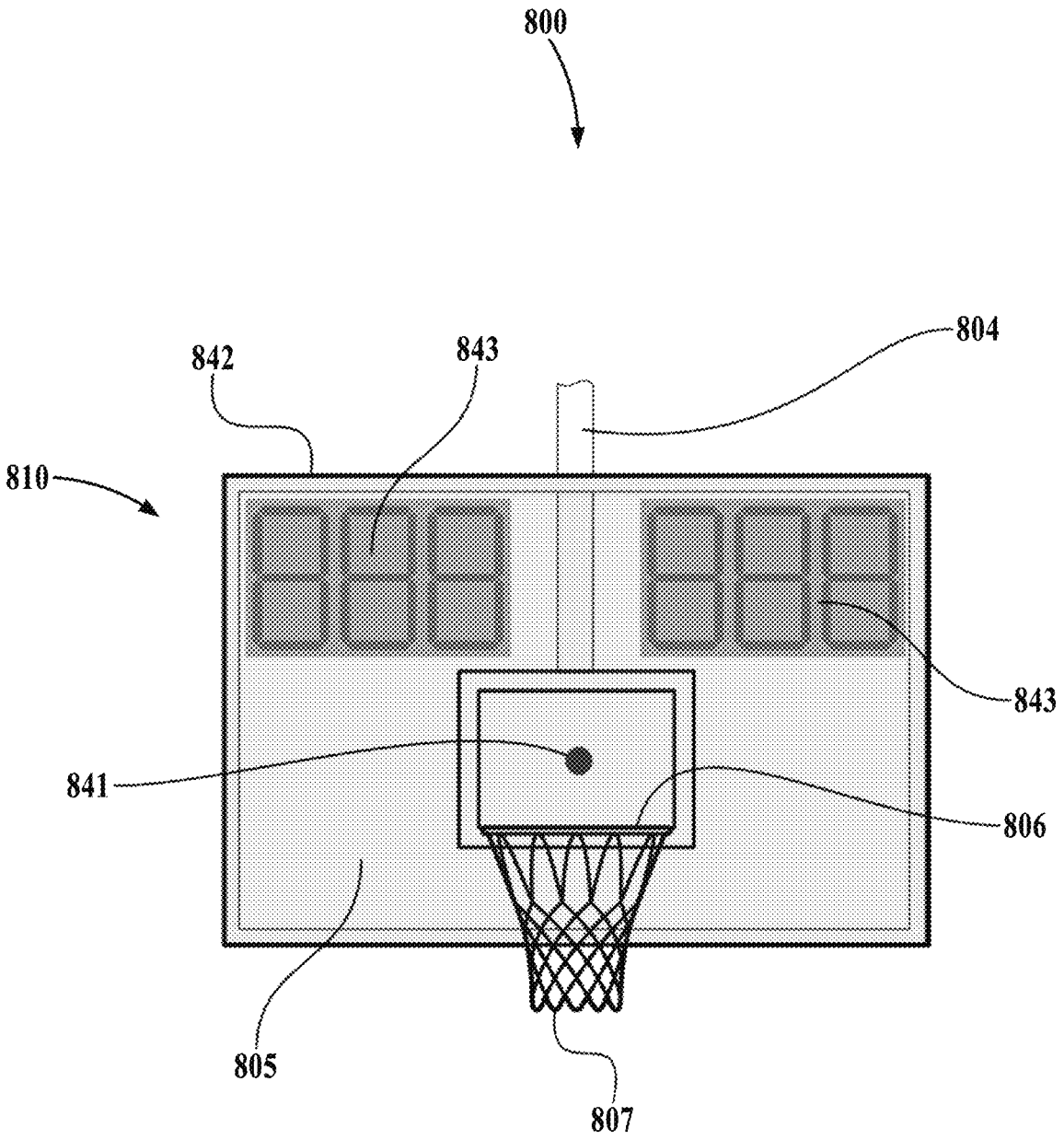
FIG. 8 illustrates a backboard mechanism with embedded lighting, displays, and sensor in accordance with an embodiment of the present disclosure.

FIG. 8 illustrates a backboard mechanism capable of performing data input/output activities via embedded lighting, displays, and a sensor in accordance with an embodiment of the present disclosure. The goal structure 810 with backboard 805, hoop 806, and net 807 is mounted to the shaft 804 as illustrated in previous figures. The backboard 805 however is enhanced in this embodiment, having embedded display elements 843 which provide lighted feedback in the form of numbers, letters, or varied imagery that can rapidly convey information about the current training session. Edge lighting 842 provides yet another form of feedback to the athlete by varying the color of the backboard's perimeter to indicate the status of play. Both lighted elements provide additional feedback to the athlete while allowing them to retain their focus on the backboard 805 during training. The source of the lighting can be LEDs or other efficient and durable lighting components known in the art. An operator can adjust the brightness of the lighting as desired, to maximize visibility, or to minimize eyestrain. Also embedded within the backboard 805, and situated a small distance above the hoop 806, an impact sensor 841 provides feedback to the control system that identifies the impact of the basketball onto the backboard, and can gauge the force applied by the ball. The control system utilized by the sports training system 800 provides a means of data relay such that incoming sensory data registered by the enhanced backboard 805 can be processed and returned to the embedded lighting elements, for real time feedback related to athlete performance and ball physics.

Figure 9:
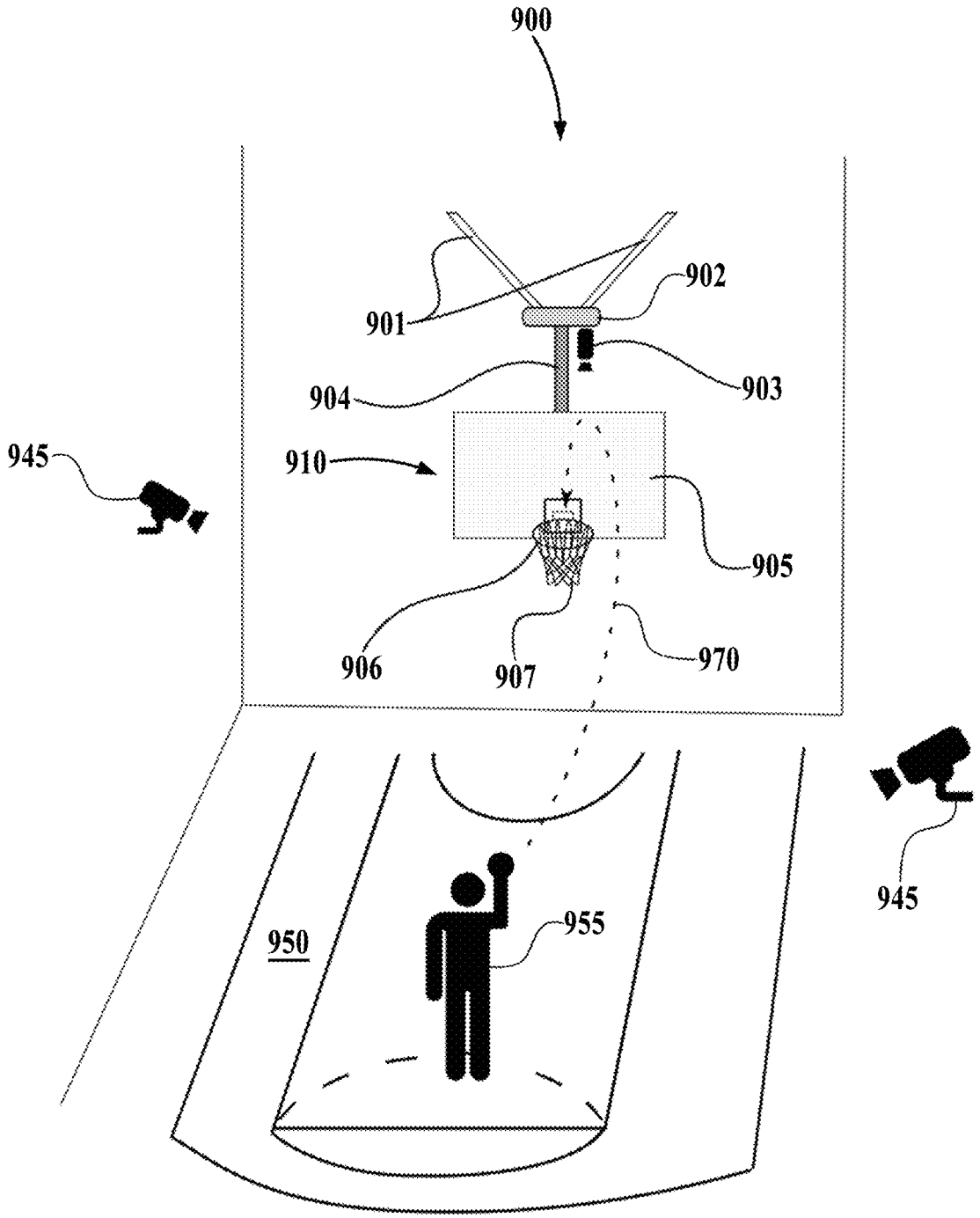
FIG. 9 illustrates a camera-enhanced athletic training space in accordance with an embodiment of the present disclosure.

FIG. 9 illustrates one embodiment of the sports training system installed into a camera-enhanced training space. The sports training system 900 comprising mounting infrastructure 901, pivot mechanism 902, shaft 904, and goal structure 910 with backboard 905, hoop 906, and net 907, is situated on the back wall of a training space. An athlete 955 stands centrally on the court 950, having a direct view of the front of the goal structure 910. The above-mentioned ball sensor 903 situated above the goal structure 910 provides one source of input data to the sports training system 900 by detecting shot attempts, completions, and other relevant data. Flanking the athlete 955 and mounted higher up on the side walls of the training space, cameras 945 provide visual coverage of the training space. The cameras 945 provide a continuous input into the control system (see control system 725 of FIG. 7), which uses optical recognition and tracking to determine both athlete and basketball position and motion. A further aspect of this embodiment allows for real time processing of received optical data in order to recognize shot attempts and basketball trajectory 970 once the shot is made. Additionally, basketball trajectory data, combined with positional reference data for the goal structure 910, can determine shot accuracy and provide "score vs. miss" analysis and prediction for current and successive training sessions.

Figure 10:
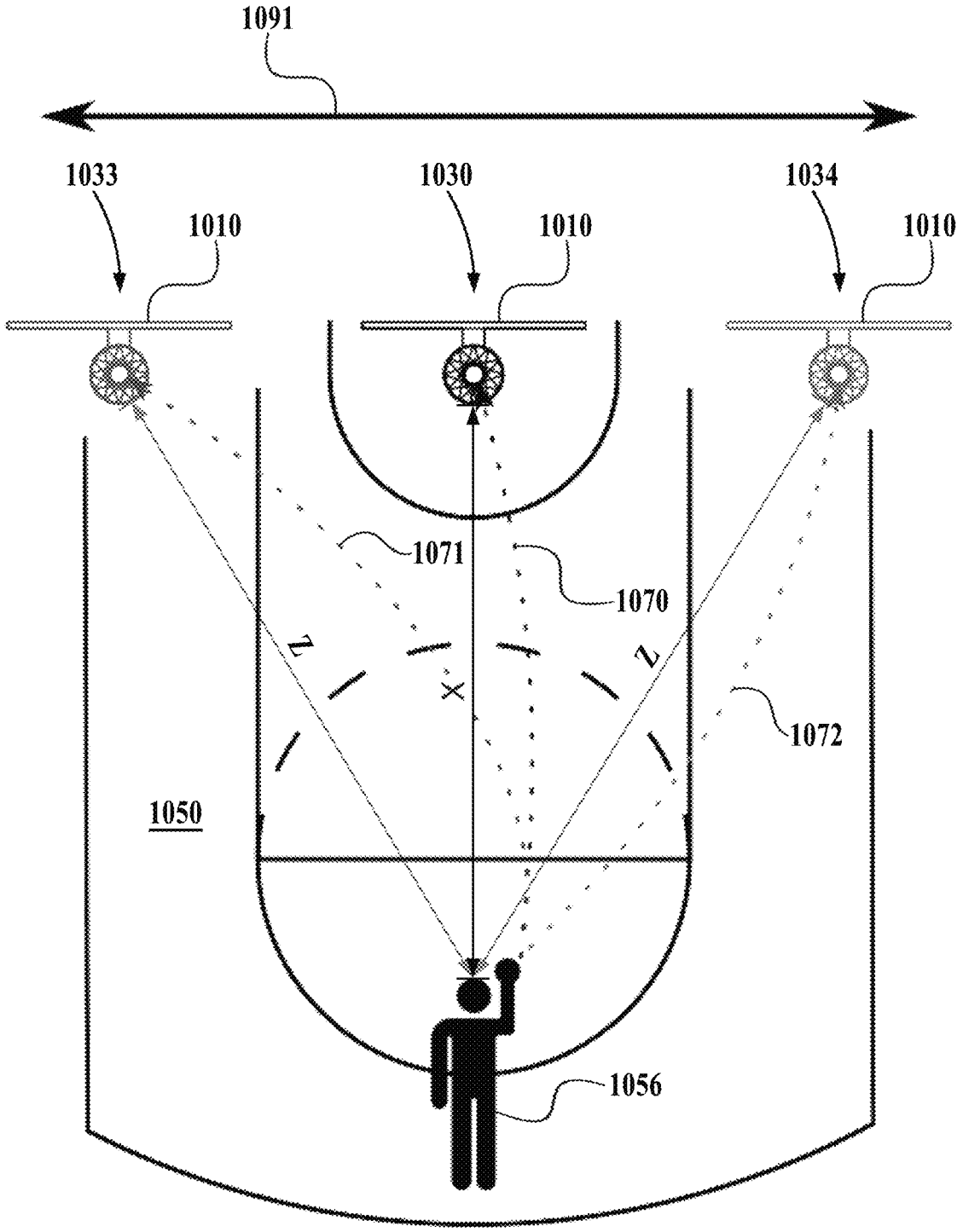
FIG. 10 illustrates training configurations in "Scenarios A, D, and E" and the spatial effects caused by lateral motion of the basketball backboard, hoop, and net in accordance with an embodiment of the present disclosure.

FIG. 10 illustrates training configurations in "Scenarios A, D, and E" and the spatial effects caused by lateral motion of the basketball backboard, hoop, and net in accordance with an embodiment of the present disclosure. In all three scenarios, the athlete remains stationary in the aforementioned central position 1056 on the court 1050. "Scenario A" shows the goal structure 1010 in training configuration 1030, or a "normal position" that is unmoved laterally. Here the athlete stands at a distance X from the goal structure 1010 and shoots the ball directly toward it, as depicted by dashed line 1070. In "Scenarios D and E", the lateral motion 1091 of the goal structure 1010 changes the spatial relationship between the athlete and the hoop. Looking now at "Scenario D", the goal structure 1010 is adjusted laterally into training configuration 1033, displacing it some distance away and to the left of training configuration 1030. In this configuration, the goal structure 1010 is now further away from the athlete in central position 1056, this new distance indicated by line Z, and the athlete must pivot counterclockwise by some degree in order to face the goal structure 1010 and make a shot, the trajectory of which is depicted by dashed line 1071. Having pivoted to face the goal structure 1010 in this new position, the athlete gains an angled view dominated by the right side of the goal structure. In "Scenario E", the goal structure 1010 is adjusted laterally into training configuration 1034, displacing it some distance away and to the right of training configuration 1030. In this configuration, the goal structure 1010 is again further away (relative to configuration 1030) from the athlete in central position 1056, this distance also indicated by line Z, and the athlete must now pivot clockwise by some degree in order to face the goal structure 1010 and make a shot, the trajectory of which is depicted by dashed line 1072. Having pivoted to face the goal structure 1010 in this new position, the athlete gains an angled view dominated by the left side of the goal structure. The type of lateral motion disclosed in this embodiment can allow for a reduced space for athletic training. As well, the effects created by side-to-side motion of the goal structure 1010 provide for a further diversified training experience for the athlete, full team, or other groups of players in a training space.

Figure 11:
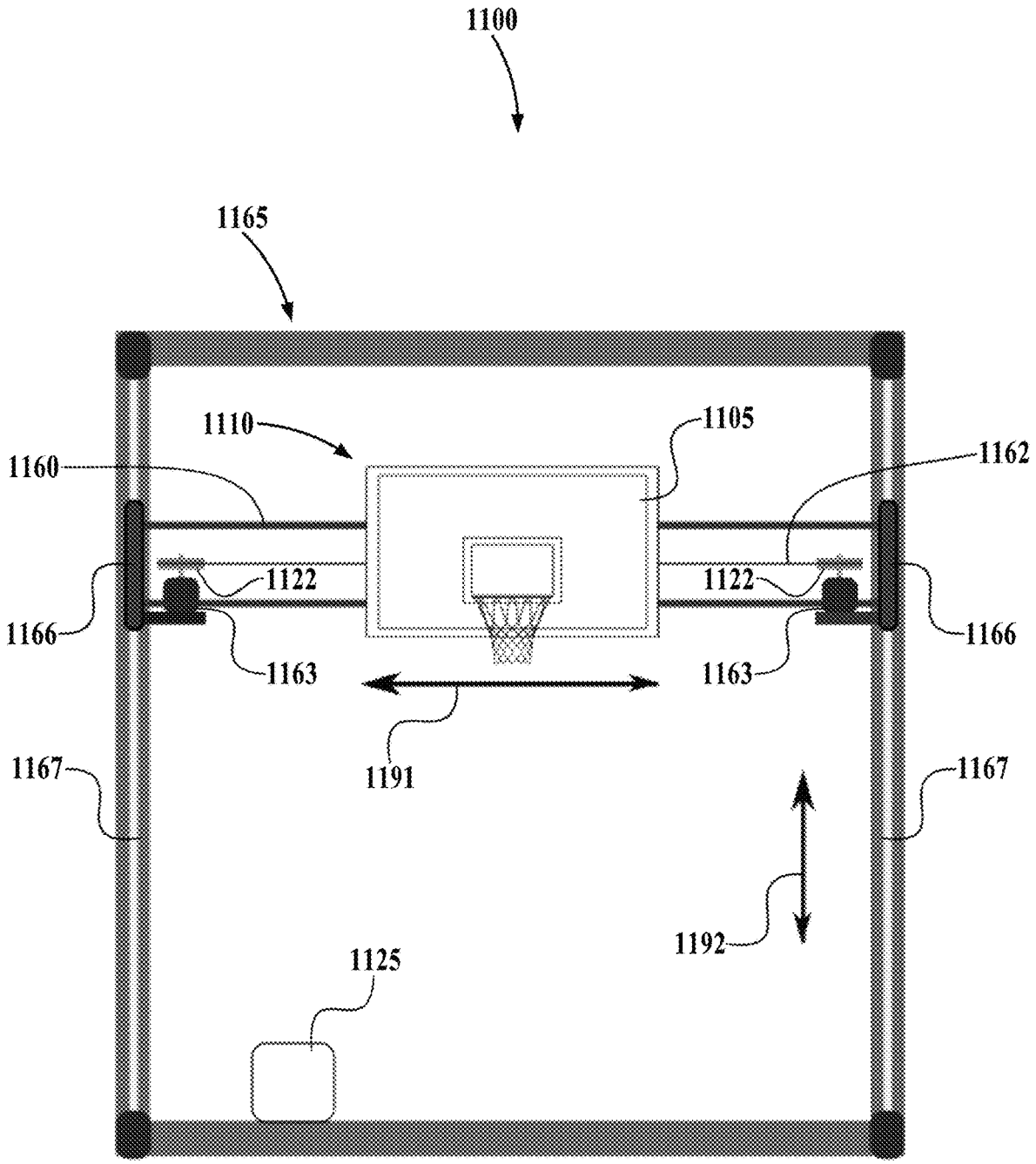
FIG. 11 illustrates a front view of a linear motion mechanism with respective directions of motion in accordance with an embodiment of the present disclosure.

FIG. 11 illustrates a front view of one embodiment of a mechanism providing linear motion along both vertical and horizontal axes for a sports training system 1100. A linear motion mechanism capable of providing lateral motion for a goal structure 1110 with backboard 1105 comprises a lateral track structure 1160 onto which the entire goal structure is mounted via a set of bearings (see linear bearings 1261 of FIG. 12) found on the backboard. The track structure 1160 is flanked by a drive motor 1163 near each end, each motor having a gear 1122 (similar to the motorized gear/chain rotation mechanism of FIG. 7) which engages with a drive belt 1162 that runs the length of the lateral track structure 1160 and is fixed to the backboard 1105. In another embodiment, the belt may be substituted with a chain. The activity of the motors 1163 rotates the gears 1122 in either a clockwise or counterclockwise direction to rotate the belt 1162, thus affecting the lateral position of the attached goal structure 1110, for near infinite adjustability along a horizontal axis, as indicated by lateral motion arrows 1191. Each end of the track structure 1160 is mounted to a linear slide mechanism 1166 that allows for up-and-down motion of the entire track structure with mounted goal structure 1110, as indicated by vertical motion arrows 1192. The whole assembly is mounted within a larger frame structure 1165, which further comprises vertical rails 1167. The linear slide mechanisms 1166 are installed into the vertical rails 1167 of the larger frame structure 1165 so that the entire lateral track structure 1160 can freely move up-and-down. In one embodiment of the present invention, the motorized linear slide mechanism 1166 may be threaded to implement vertical motion 1192 using threaded lead screw components, providing structural stability along with precisely executed motion. As well, multi-axis components can be utilized within a single motor system to optimize space for the linear motion mechanism. A computerized control system 1125 manages the functioning of the overall system 1100, including programmable linear movement of the motion mechanism and automated or user-initiated training programs. Some training programs can offer randomized activities that quicken the athlete's reaction times by exposing them to unorthodox training stimuli. Overall athlete performance can be improved and new skills honed when computer-aided training methods are implemented.

Figure 12:
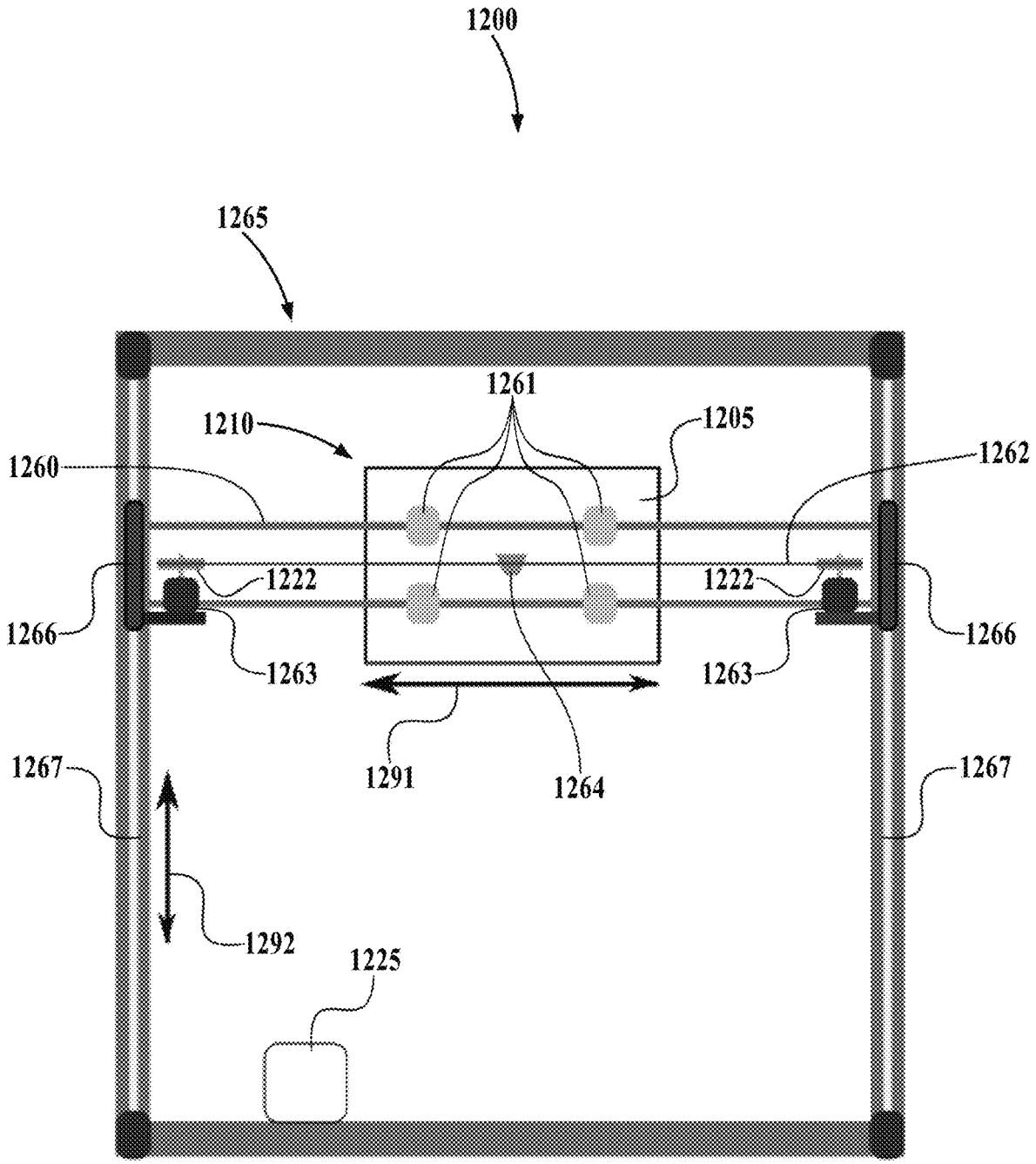
FIG. 12 illustrates a back view of a linear motion mechanism with respective directions of motion in accordance with an embodiment of the present disclosure.

FIG. 12 illustrates a back view of one embodiment of a mechanism providing linear motion along both vertical and horizontal axes for a sports training system 1200. In this view, the rear side of the goal structure 1210 can be seen, with the rear of the backboard 1205 providing a large mounting surface for various elements used for linear motion. In this embodiment, the backboard 1205 is mounted to four linear bearings 1261 which provide slidable contact with the lateral track structure 1260. The previously mentioned drive belt 1262 has a point of fixation to the rear of the backboard 1205 with anchor 1264, so that belt motion translates directly to backboard motion. The powered side-to-side motion occurs when drive motors 1263 drive the belt 1262 with gears 1222 that are mounted on each side of the lateral track structure 1260. The slidable contact points between linear bearings 1261 and lateral track structure 1260 allow freedom of lateral motion along a horizontal axis, indicated by motion arrows 1291. The lateral track structure 1260 terminates on each side with linear slide mechanisms 1266 embedded within the vertical rails 1267 of the larger frame structure 1265, allowing for slidable up-and-down motion of the entire track structure, including mounted goal structure 1210, along a vertical axis, as indicated by motion arrows 1292. The computerized control system 1225 is depicted near the floor, or attached to some surface of the frame structure 1265 for illustrative purposes. Some embodiments can utilize a wireless version of the control system 1225 and certain wirelessly linked hardware components to enable over-the-air data transfer in some instances. In yet another embodiment, linear motion mechanisms, similar to those described above, can be integrated into the system 1200 in order to provide motion of the goal structure 1210 in an additional axis, for front-to-back movement.

Figure 13:
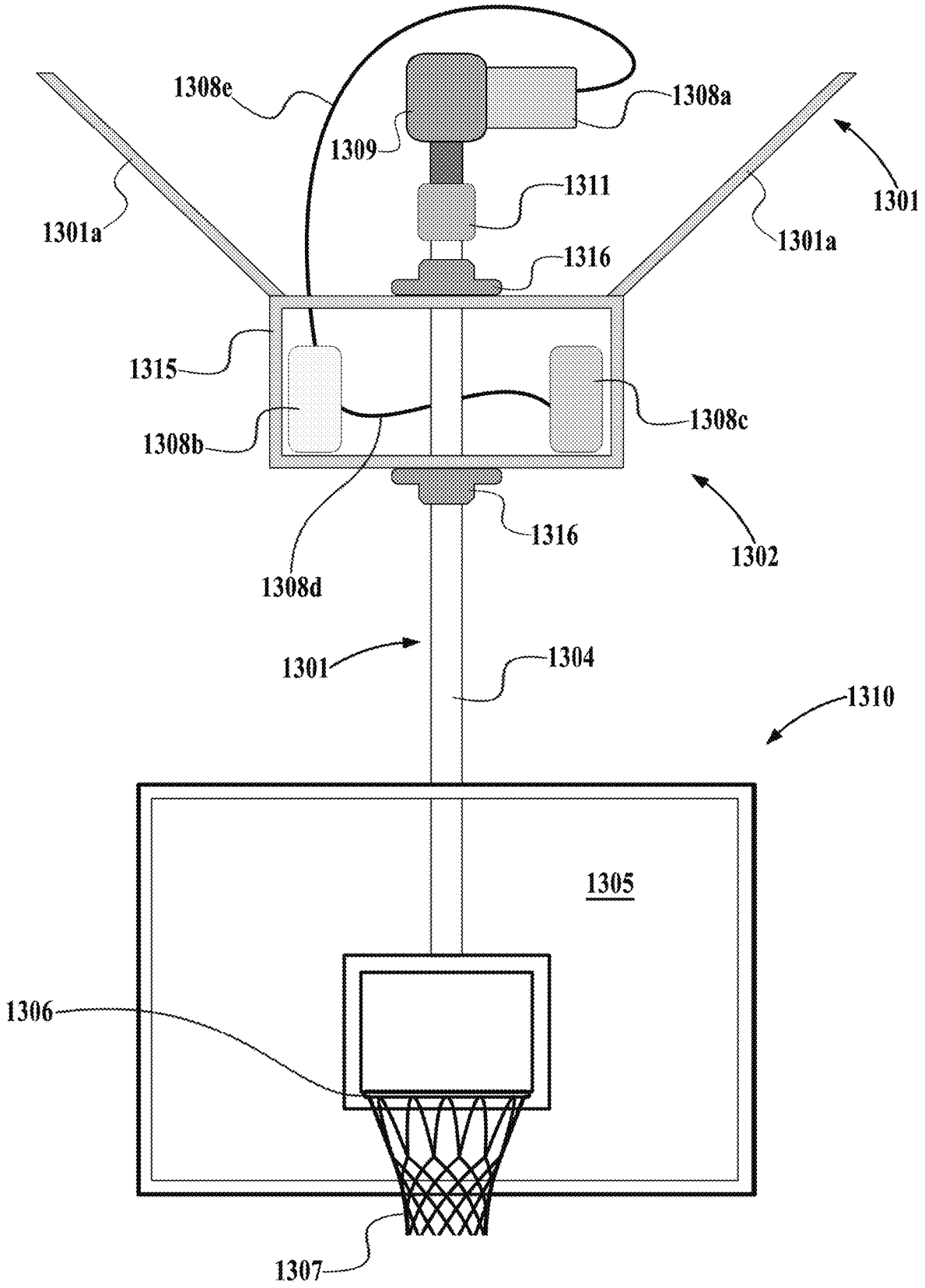
FIG. 13 illustrates another embodiment of the pivot mechanism in accordance with the present disclosure.

FIG. 13 illustrates another embodiment of a pivot mechanism 1302 mounted to a rotatable shaft 1304. A sports training system includes a mounting infrastructure 1301 comprising a pair of angled arms 1301*a* and a cylindrical shaft 1304 having a superior portion and an inferior portion. The superior portion of the shaft 1304 is positioned between the angled arms 1301*a*, each angled arm terminating at two opposing fixed ends. A goal structure 1310 is fixed to the shaft 1304, the goal structure comprising a backboard 1305 with an attached hoop 1306, the hoop having an attached net 1307, the goal structure fixed to the shaft's inferior portion. The shaft 1304 couples a mechanical rotational assembly (this assembly closely associated with the pivot mechanism 1302) to the goal structure 1310. The pivot mechanism 1302 comprises a servomechanism, a gearbox 1309, a shaft coupler 1311, a housing 1315, and a pair of bearings 1316 through which the shaft 1304 runs. One bearing 1316 is positioned at the superior portion of the shaft 1304 while the other bearing is positioned at the inferior portion. The housing 1315 is attached to each angled arm 1301 at a fixed end, the opposing fixed ends positioned further away from the superior portion of the shaft 1304 than those fixed ends attached to the housing 1315. The shaft coupler 1311 rigidly connects the gearbox 1309 to the superior portion of the shaft 1304. An exemplary shaft coupler 1311 is a heavy duty component having optimal deflection and torque characteristics for its connective application.

The servomechanism comprises a servomotor 1308*a* connected to the gearbox 1309, the servomotor providing rotational movement of the shaft 1304 and connected goal structure 1310. An exemplary servomotor 1308*a* and gearbox 1309 are designed to couple together via bolting, in order to become one unit. The servomechanism further comprises a drive device 1308*b*, a DC power supply 1308*c*, a DC power cable 1308*d*, and a servomotor cable 1308*c*. The DC power supply 1308*c* is in electrical communication with the drive device 1308*b* via the DC power cable 1308*d*, the drive device being in electrical communication with the servomotor 1308*a* via the servomotor cable 1308*e*. The gearbox 1309 increases torque provided by the servomotor 1308*a*. The DC power supply 1308*c*, DC power cable 1308*d*, and drive device 1308*b* are all contained within the housing, the housing vertically positioned on the shaft 1304 between the bearings 1316. The drive device 1308*b* receives commands from electrical inputs with logic level connectivity and ethernet connectivity. Such commands include positional commands, motion-stopping commands, and position-locking commands for adjustments of the pivot mechanism 1302.

The servomotor 1308*a* provides rotational movement of the shaft 1304, and includes a built-in position sensor and an internal brake to prevent rotation from occurring when not desired. The position sensor further allows the system to initialize to a standard rotational position upon power loss, or due to movement when not in use. The high ratio gearbox 1309 utilizes gear ratios lying in a range between 80:1 to 100:1 that increase the torque produced by the servomotor 1308*a*, the gear ratios being user selectable in one example. The gearbox 1309 further increases the angular positioning ability of the pivot mechanism 1302 to an accuracy of within 30 arc minutes, or half a degree. A rotationally accurate shaft coupler 1311 is preferred. The shaft coupler 1311 maintains angular positioning accuracy while rigidly connecting the gearbox 1309 to the shaft 1304, promoting the ability to absorb the maximum force of an angular impact incurred by a basketball at a distal edge of the backboard 1305. This force absorption allows the dissipation of vibration while maintaining alignment of the backboard 1305 with no noticeable drift or flexing.

The upper, or superior, bearing 1316 and the lower, or inferior, bearing 1316 allow smooth rotational motion of the shaft 1304 while holding its structural position, specifically its vertical axial alignment. The drive device 1308*b* provides the correct electrical signals to control the servomotor 1308*a* using specific programmed values for angular position, acceleration, velocity, and jerk, ensuring smooth motion of the backboard 1305 and goal structure 1310 as a whole. This enables smooth, precise, and repeatable movement to a given pivot angle based on weight and movements of the backboard 1305. These values, or variables, are determined and programmed specifically for the backboard 1305 used (e.g. tempered glass, lexan, wood, etc). The specific values for acceleration, velocity, and jerk are further calculated based upon the weight, material composition, movements, and construction of the hoop 1306, connecting shaft assemblies, backboard 1305 and goal structure 1310 as a whole. The drive device 1308*b* also stores position data in non-volatile memory. The drive device 1308*b* can receive positional commands from either electrical inputs or via an ethernet connection using a client/server data communications protocol such as MODBUS.

The housing 1315 provides an enclosed case for the above-mentioned electrical components, such that they are both protected from accidental impact (e.g. from a basketball) and provide electrical safety. The servomotor cable 1308*e* electrically connects the servomotor 1308*a* with the drive device 1308*b* while carrying power and signals sensing shaft position and faults. The DC power supply 1308*c* provides low voltage DC at the current requirements of the present electrical system. The DC power cable 1308*d* connects the DC power supply 1308*c* with the drive device 1308*b*. The rotatable shaft 1304 connects the gearbox 1309 to the backboard 1305 and goal structure 1310, the shaft positioned vertically between these elements. The backboard 1305 can be up to a full standard size of 72 inches by 48 inches, and composed of tempered glass. In another example, the backboard 1305 may be smaller and/or built with lighter materials.

Figure 14:
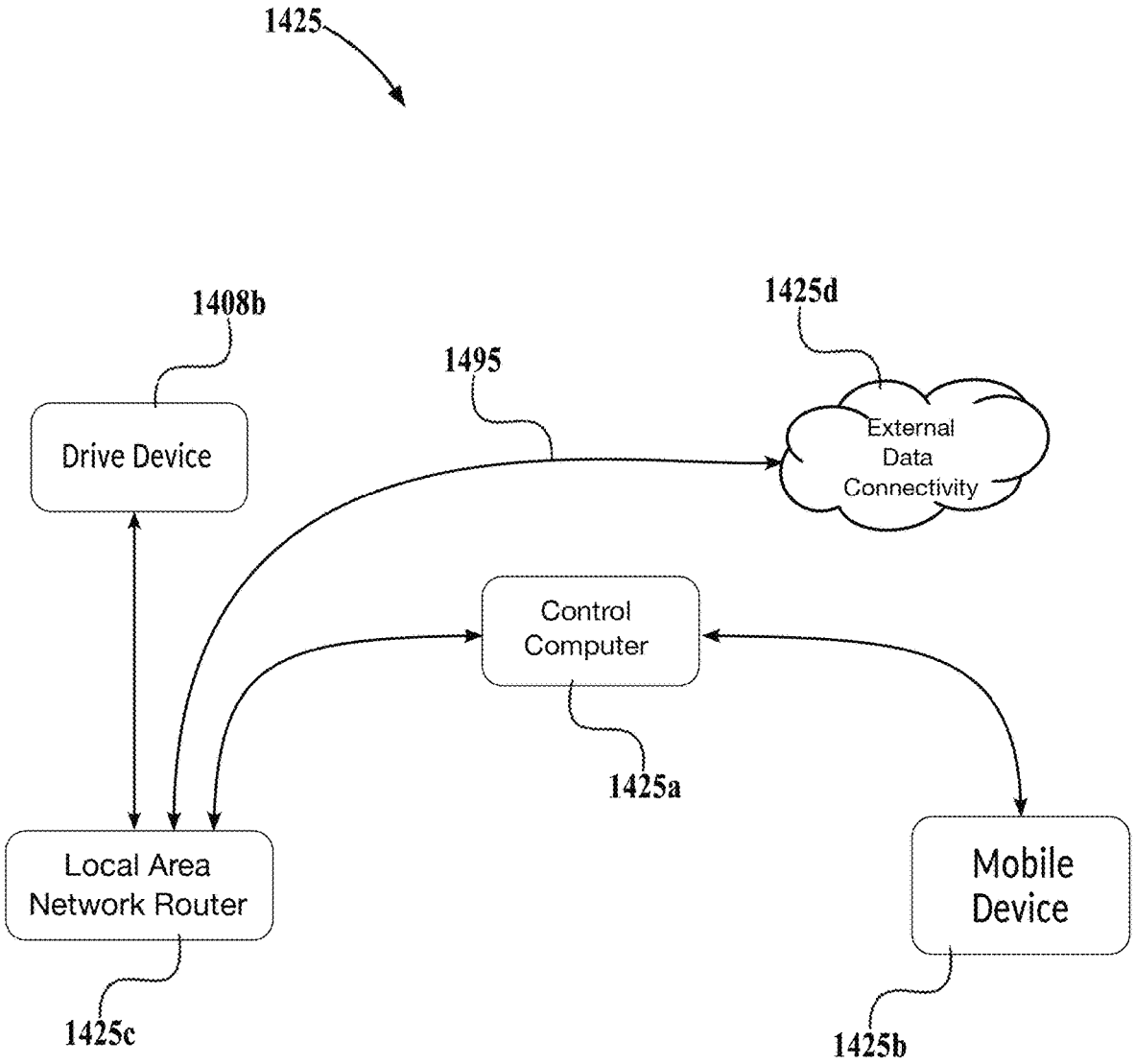
FIG. 14 illustrates a high-level diagram of a computerized control system for the pivot mechanism in accordance with an embodiment of the present disclosure.

FIG. 14 illustrates a high level diagram of a computerized control system 1425 for remotely adjusting the pivot mechanism, the system 1425 providing at least one user interface, receiving input/selections from a user, sending positional commands to the drive device (in some examples via ethernet) based on user input, or based on user-defined programs for training sessions and challenges. The control system 1425 provides transmission of specific position angles to the drive device 1408*b*, commands to lock or unlock the drive device to prevent motion, and allows reception of updated position data as the pivot mechanism rotates the goal structure.

Two-way communication arrows 1495 shown throughout the diagram indicate two-way data transmission between the illustrated elements of the computerized control system 1425. A control computer, or central computing device 1425*a* runs a linux-based operating system and control software that consists of a web server and a browser to display a user interface via which a user can interact with the sports training system, including the pivot mechanism and other computerized elements. The central computing device 1425*a* further includes a javascript engine to support programming of user challenges, web sockets, and python to support communication with the drive device 1408*b* using MODBUS, providing automated periodic movement of the pivot mechanism. A local area network router 1425*c* establishes a local area network for connecting the drive device 1408*b* and the central computing device 1425*a*. The local router 1425*c* may have an internet connection for cloud connectivity 1425*d*. The central computing device's web server connects to a local touch screen, or any mobile computing device 1425*b* that supports a web browser, while being connected to the local area network using WiFi. In some examples, the mobile computing device can be installed with a dedicated mobile application for interaction with the control system 1425. Thus the mobile computing device 1425*b* is in wireless communication with the central computing device 1425*a* in order to manipulate the drive device 1408*b*. A touch screen display of the mobile computing device 1425*b*, displays a mobile user interface and receives commands via user interaction, these commands instructing the drive device 1408*b* to physically adjust the goal structure. The user commands also initiate training programs and challenges, further allowing adjustment of challenge parameters (see FIGS. 15 and 16 for user interface screens). The drive device 1408*b* includes both logic level inputs and an ethernet connection for use of MODBUS communications.

Figure 15:
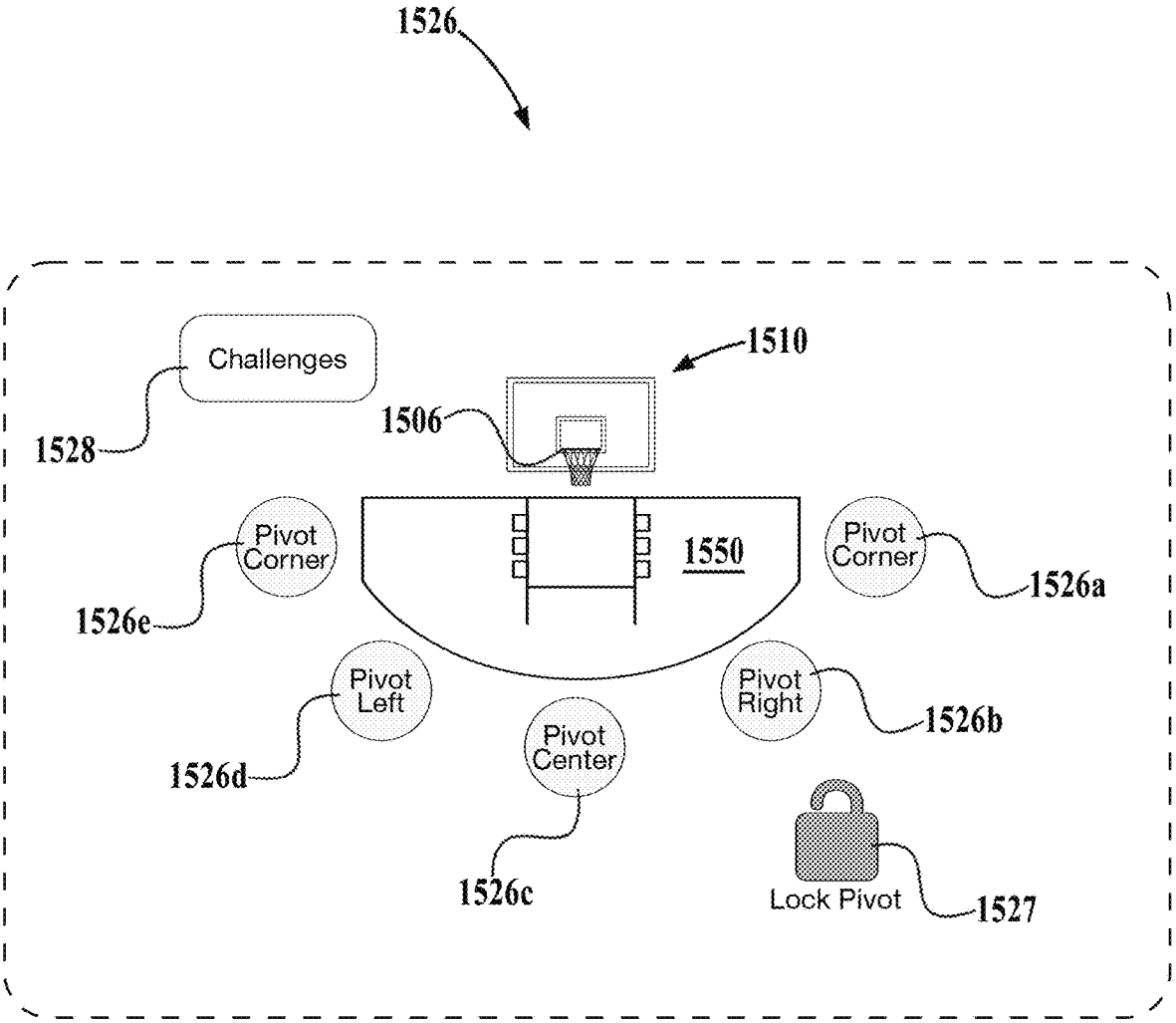
FIG. 15 illustrates a graphical user interface screen for remotely operating the pivot mechanism in accordance with an embodiment of the present disclosure.

FIG. 15 illustrates a graphical user interface (UI) screen, or pivot operation screen 1526 for remotely operating the pivot mechanism to adjust a goal structure 1510 on a court 1550. In one example of usage, a user/athlete manually selects a rotation angle for the goal structure 1510 by interacting with the UI to select a desired pivot position from a touch screen. The UI provides touchable buttons or icons at "simulated" court positions used for training, these depicted court positions previewing the angle of hoop access given to the athlete per each pivot setting of the goal structure 1510. The touchable buttons are graphically laid out, each aligned with their respective pivot setting's hoop orientation, and contain text indicating their function. The user is free to change their location relative to the goal structure 1510. Thus, in a reduced footprint space/court, the present system provides the athlete with an equivalent training situation that would be experienced in a standard half-court having a stationary/standard goal structure 1510.

A graphical element for a pivot locking setting 1527, when pressed, changes graphically between an open lock icon and a closed lock icon. In one example, the lock icon also changes color from red to green, indicating that the goal structure 1510 is prevented from moving (locked) or permitted to move (unlocked), respectively. A graphical element for a center pivot setting 1526*c*, when pressed, will cause the goal structure 1510 to rotate to a standard, centered position, or to a 0 degree position. The center pivot setting 1526*c* is positioned graphically on the UI screen 1526 to indicate the final orientation of the backboard goal. It is positioned graphically on the UI to indicate the final orientation of the goal structure 1510. Other pivot settings discussed hereafter for FIG. 15 are associated with degree values that are measured relative to the hoop 1506 at the centered position. A graphical element for a right pivot setting 1526*b*, when pressed, causes the goal structure 1510 to rotate 45 degrees to the right, or to a +45 degree position. The right pivot setting 1526*b* is positioned graphically on the UI screen 1526 to indicate the final orientation of the goal structure 1510. A graphical element for a right corner pivot setting 1526*a*, when pressed, causes the goal structure 1510 to rotate 70 degrees to the right, or to a +70 degree position. The right corner pivot setting 1526*a* is positioned graphically on the UI screen 1526 to indicate the final orientation of the goal structure 1510. Using this right corner orientation is equivalent to the user being at the far inbounds right corner of a standard half-court gym. A graphical element for a left pivot setting 1526*d*, when pressed causes the goal structure 1510 to rotate 45 degrees to the left, or to a −45 degree position. The left pivot setting 1526*d* is positioned graphically on the UI screen 1526 to indicate the final orientation of the goal structure 1510. A graphical element for a left corner pivot setting 1526*e*, when pressed, causes the goal structure 1510 to rotate 70 degrees to the left, or to a −70 degree position. The left corner pivot setting 1526*e* is positioned graphically on the UI screen 1526 to indicate the final orientation of the goal structure 1510. Using this left corner orientation is equivalent to the user being at the far inbounds left corner of a standard half-court gym. A graphical element for a challenge selection screen 1528, when pressed, redirects the UI to a "Challenges" page (see FIG. 16 for challenge selection screen 1628).

Figure 16:
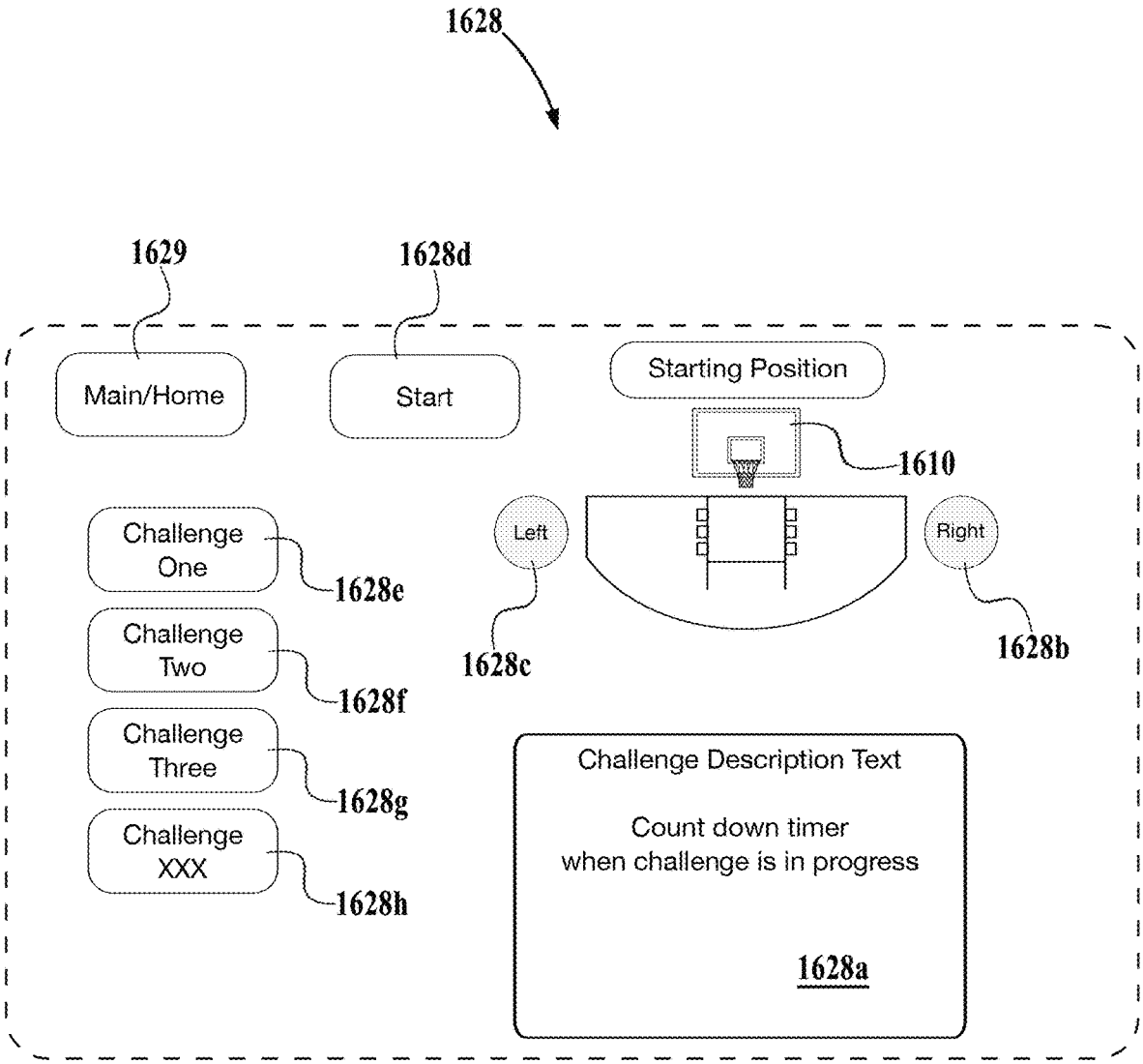
FIG. 16 illustrates a graphical user interface screen for choosing and displaying information about training programs, or challenges, in accordance with an embodiment of the present disclosure.

FIG. 16 illustrates a graphical user interface (UI) screen, or challenge selection screen 1628 for choosing and displaying information about training programs, or challenges. A graphical element for challenge information 1628*a* fills with a text-based description of a selected challenge. Upon starting a challenge, the text-based description changes to a countdown timer display window. A graphical element for a right pivot setting 1628*b* sets the starting position of the goal structure 1610 to a right pivot. A graphical element for a left pivot setting 1628*c* sets the starting position of the goal structure 1610 to a left pivot. A graphical element for challenge initiation 1628*d* starts a challenge. Selectable graphical elements indicate "challenge one" 1628*e*, "challenge two" 1628*f*, and "challenge three" 1628*g*, while the graphical element for "challenge XXX" 1628*h* selects greater than 3 challenges. Another selectable graphical element indicates a "Main/Home" screen 1629, which returns the UI back to its home screen.

FIGS. 17A-B illustrate equivalent training whether using a goal structure 1710 with pivot mechanism in a size-reduced half-court 1750 (seen in FIG. 17B, the reduced court having a width R of about 20 feet), or using a standard goal structure 1710 in a standard position in a standard half-court (seen in FIG. 17A, the standard court having a width S of about 50 feet). The pivot mechanism can rotate the goal structure 1710 to the same position that a player 1755 would see while positioned in the left or right inbounds "corner" of the standard half-court 1750 shown in FIG. 17A. Distance C measures the distance between the player 1755 (in the "corner" of the standard half court) and the goal structure 1710. This equates to the most oblique angle of side access the player 1755 would have to the goal structure 1710 on the standard half-court and still be inbounds. Based on the reduced width of the court shown in FIG. 17B, an angle θ is calculated (the angle's origin being the center of the backboard 1705, distance C being aligned with the backboard's length axis in either training scenario) in order to find the amount of rotation needed to pivot the goal structure 1710 to achieve the same training scenario that the player would experience in the standard half-court, with the player positioned at the same distance C from the goal structure 1710. Angle θ measures about 45 degrees, this measurement relative to rotation of the backboard 1705. Thus, the goal structure 1710 can be pivoted approximately +/−45 degrees from the standard position in a half-court 1750 having a reduced width of approximately 20 feet, such that the player 1755 has side access to the goal structure 1710 while positioned inbound at a distance away from the goal structure that is equivalent to the distance between a standard goal structure and a player positioned at either of the far inbound corners of a standard sized half-court having a standard width of approximately 50 feet.

Figure 18:
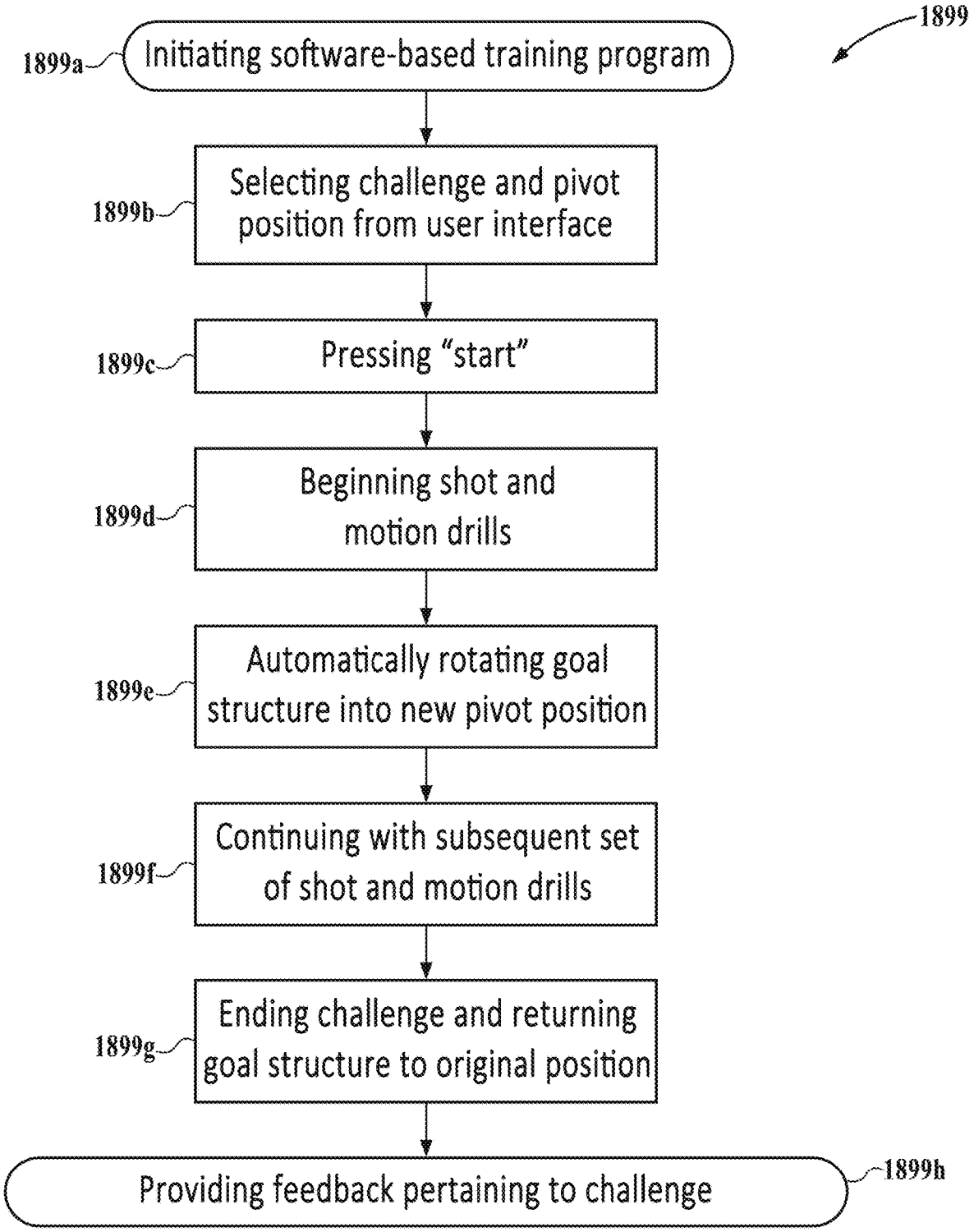
FIG. 18 illustrates a process for using a user interface to adjust a pivot mechanism and select challenges in accordance with an embodiment of the present disclosure.

FIG. 18 illustrates a process 1899 for using a user interface to adjust a pivot mechanism and select challenges in accordance with an embodiment of the present disclosure. Step 1899*a* indicates the initiation of the sports training system's software-based training program for use by an athlete in a basketball training court. The training program includes various challenges for the athlete, the training program running on the above-mentioned central computing device that is connected to the network router. One example of such a training program includes a "90 second challenge"; a plurality of varied time challenges are provided. The training program is accessible by the athlete via the graphical user interface, or challenge selection screen, running on a mobile computing device that is in communication with the central computing device. The pivot mechanism is adjustable via the graphical user interface. Step 1899*b* indicates the selection of a challenge and pivot position from the user interface. The challenge has certain parameters, and includes dribbling and shooting basketballs toward the goal structure. In some examples of challenges, the pivot position is either oriented to the "left" or "right" relative to a standard training scenario on a standard court with a standard goal structure. Step 1899*c* indicates pressing "start" on the user interface. Step 1899*d* indicates beginning shot and motion drills, the drills including dribble sets, shots from stationary and non-stationary positions, and layups. Step 1899*e* indicates automatically rotating the goal structure into a new pivot position, the rotation executed by the central computing device after a designated time. Step 1899*f* indicates continuing with a subsequent set of shot and motion drills at the newly adjusted pivot position, which continues until all of the positions have been reached. Step 1899*g* indicates concluding the selected challenge and returning the goal structure to its original position via the pivot mechanism, and automatically via the central computing device. Step 1899*h* indicates providing feedback pertaining to the challenge, the feedback displayed on both the user interface and the backboard display of the goal structure. In one example, both user interface and backboard show a countdown timer, with time remaining in each position.

Many variations may be made to the embodiments described herein. All variations are intended to be included within the scope of this disclosure. The description of the embodiments herein can be practiced in many ways. Any terminology used herein should not be construed as restricting the features or aspects of the disclosed subject matter. The scope should instead be construed in accordance with the appended claims.

There may be many other ways to implement the disclosed embodiments. Various functions and elements described herein may be partitioned differently from those shown without departing from the scope of the disclosed embodiments. Various modifications to these implementations may be readily apparent to those skilled in the art, and generic principles defined herein may be applied to other implementations. Thus, many changes and modifications may be made to the disclosed embodiments, by one having ordinary skill in the art, without departing from the scope of the disclosed embodiments. For instance, different numbers of a given element or module may be employed, a different type or types of a given element or module may be employed, a given element or module may be added, or a given element or module may be omitted.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

What is claimed is:

1. An adjustable sports training system installed in a training space having a basketball court, the system comprising:

(a.) a mounting infrastructure comprising a pair of angled arms and a cylindrical shaft, the shaft having a superior portion and an inferior portion, the superior portion positioned between the angled arms, each angled arm terminating at two opposing fixed ends;

(b.) a goal structure fixed to the shaft's inferior portion, the goal structure comprising a backboard with an attached hoop, the hoop having an attached net, the backboard embedded with lighted displays and a ball sensor;

(c.) a pivot mechanism configured to rotate the goal structure, the pivot mechanism mounted to the shaft and comprising a servomechanism, a high ratio gearbox, a shaft coupler, a housing, and a pair of bearings through which the shaft runs, one bearing being positioned at the shaft's superior portion while the other bearing is positioned at the inferior portion, the housing attached to each angled arm at a fixed end, the opposing fixed ends positioned further away from the shaft's superior portion than those fixed ends attached to the housing, the shaft coupler rigidly connecting the gearbox to the superior portion, the servomechanism comprising:

(i.) a servomotor connected to the gearbox and configured to provide rotational movement of the shaft and connected goal structure, a drive device having logic level and ethernet connectivity, a DC power supply, a DC power cable, and a servomotor cable, the DC power supply being in electrical communication with the drive device via the DC power cable, the drive device being in electrical communication with the servomotor via the servomotor cable, the gearbox configured to increase torque provided by the servomotor, the housing positioned between the bearings and containing the DC power supply, DC power cable, and drive device;

(d.) a computerized control system configured to remotely adjust the pivot mechanism, the control system comprising:

(i.) a central computing device;

(ii.) a local area network router in communication with both the central computing device and the drive device such that two-way data transmission occurs between all three devices, the router having cloud connectivity; and, (iii.) a mobile computing device in wireless communication with the central computing device, such that the drive device receives adjustment commands from the mobile device to rotate the goal structure via the servomechanism, the mobile device configured to have a plurality of graphical user interfaces for receiving the adjustment commands, the interfaces further receiving commands for initiating athlete training programs, the commands receivable via touch interaction.

2. The adjustable sports training system of claim 1, wherein the servomotor includes an integrated position sensor and an internal brake configured to prevent rotation from occurring when not desired, the position sensor further configured to allow the control system to initialize the pivot mechanism to a standard rotational position upon power loss, or due to movement when the sports training system is not in use.

3. The adjustable sports training system of claim 2, wherein the drive device provides electrical signals to control the servomotor using programmed values for angular position, acceleration, velocity, and jerk, the programmed values calculated based upon the weight, material composition, movements, and construction of the goal structure.

4. The adjustable sports training system of claim 3, wherein the mobile computing device's graphical interfaces include a pivot operation screen and a challenge selection screen, the pivot operation screen receiving the adjustment commands and including a graphical element for a pivot locking setting that changes graphically between an open lock icon and a closed lock icon, the challenge selection screen receiving both the adjustment commands and the training program commands, the training programs being timed and periodically providing automatic rotation of the goal structure.

5. The adjustable sports training system of claim 4, wherein the central computing device includes a javascript engine to support programming of training programs, web sockets, and python to support communication with the drive device and provide the automated periodic movement of the pivot mechanism.

6. The adjustable sports training system of claim 5, wherein the drive device is configured to receive positional commands through the logic level and ethernet connectivity using a client/server data communications protocol known as MODBUS.

7. The adjustable sports training system of claim 6, wherein the shaft coupler maintains angular positioning accuracy while rigidly connecting the gearbox to the superior portion of the shaft, promoting the ability to absorb maximal force from an angular impact incurred by a basketball at a distal edge of the backboard, the force absorption allowing the dissipation of vibration while maintaining alignment of the backboard with negligible drift or flexing, and wherein the gearbox increases the angular positioning ability of the pivot mechanism to an accuracy of within 30 arc minutes.

8. The adjustable sports training system of claim 7, wherein the high ratio gearbox utilizes gear ratios lying in a range between 80:1 to 100:1, wherein the drive device stores position data in non-volatile memory, and wherein the sports training system further comprises a plurality of cameras monitoring the training space, the cameras being in communication with the control system.

9. The adjustable sports training system of claim 8, wherein training equivalence is achieved in a size-reduced half-court where the goal structure is rotated by the pivot mechanism, the training relative to that accomplished in a standard half-court having a standard width of approximately 50 feet, the size-reduced half-court having a reduced width of approximately 20 feet.

10. An adjustable sports training system installed in a training space having a basketball court, the system comprising:

(a.) a mounting infrastructure comprising a pair of angled arms and a cylindrical shaft, the shaft having a superior portion and an inferior portion, the superior portion positioned between the angled arms;

(b.) a goal structure fixed to the shaft's inferior portion;

(c.) a pivot mechanism configured to rotate the goal structure, the pivot mechanism positioned at the shaft's superior portion and comprising:

(i.) a servomechanism comprising a servomotor and a drive device, the servomotor comprising an integrated position sensor and an internal brake, the drive device configured to receive positional commands via logic level and ethernet connectivity using a client/server data communications protocol known as MODBUS;

(ii.) a high ratio gearbox;

(iii.) a shaft coupler rigidly connecting the gearbox to the shaft's superior portion;

(iv.) a housing containing the drive device;

(v.) a pair of bearings through which the shaft runs;

(d.) a computerized control system configured to remotely adjust the pivot mechanism, the control system comprising:

(i.) a central computing device having a javascript engine to support communication with the drive device and provide automated periodic movement of the pivot mechanism;

(ii.) a local area network router in communication with both the central computing device and the drive device such that two-way data transmission occurs between all three devices, the router having cloud connectivity;

(iii.) a mobile computing device in wireless communication with the central computing device, such that the drive device receives adjustment commands from the mobile device to rotate the goal structure via the pivot mechanism, the mobile device configured to have a plurality of graphical user interfaces for receiving adjustment commands to rotate the goal structure, the interfaces further receiving commands for initiating athlete training programs, the interfaces including a pivot operation screen and a challenge selection screen; and (e.) a plurality of cameras monitoring the training space, the cameras being in communication with the control system.

11. The adjustable sports training system of claim 10, wherein the position sensor is configured to allow the control system to initialize the pivot mechanism to a standard rotational position upon power loss, or due to movement when the sports training system is not in use.

12. The adjustable sports training system of claim 11, wherein the drive device provides electrical signals to control the servomotor using programmed values for angular position, acceleration, velocity, and jerk, the programmed values calculated based upon the weight, material composition, movements, and construction of the goal structure.

13. The adjustable sports training system of claim 12, wherein the pivot operation screen includes a graphical element for a pivot locking setting that changes graphically between an open lock icon and a closed lock icon, and wherein the challenge selection screen receives both the adjustment commands and the training program commands, the training programs being timed and periodically providing automatic rotation of the goal structure.

14. The adjustable sports training system of claim 13, wherein the shaft coupler maintains angular positioning accuracy while rigidly connecting the gearbox to the superior portion of the shaft, promoting the ability to absorb maximal force from an angular impact incurred by a basketball at a distal edge of the backboard, the force absorption allowing the dissipation of vibration while maintaining alignment of the backboard with negligible drift or flexing, and wherein the gearbox increases the angular positioning ability of the pivot mechanism to an accuracy of within 30 arc minutes.

15. The adjustable sports training system of claim 14, wherein the high ratio gearbox utilizes gear ratios lying in a range between 80:1 to 100:1.

16. The adjustable sports training system of claim 15, wherein the drive device stores position data in non-volatile memory.

17. The adjustable sports training system of claim 16, wherein training equivalence is achieved in a size-reduced half-court where the goal structure is rotated by the pivot mechanism, the training relative to that accomplished in a standard half-court having a standard width of approximately 50 feet, the size-reduced half-court having a reduced width of approximately 20 feet.

* * * * *